US010559921B2

(12) United States Patent
Sakaue et al.

(10) Patent No.: US 10,559,921 B2
(45) Date of Patent: Feb. 11, 2020

(54) CONNECTOR

(71) Applicant: IRISO ELECTRONICS CO., LTD., Yokohama-shi, Kanagawa (JP)

(72) Inventors: Jyunya Sakaue, Yokohama (JP); Hideki Shioda, Yokohama (JP); Yoshihito Ohkuma, Yokohama (JP)

(73) Assignee: IRISO ELECTRONICS CO., LTD., Yokohama-Shi, Kanagawa (JP)

( * ) Notice: Subject to any disclaimer, the term of this patent is extended or adjusted under 35 U.S.C. 154(b) by 25 days.

(21) Appl. No.: 16/037,123

(22) Filed: Jul. 17, 2018

(65) Prior Publication Data

US 2019/0027865 A1 Jan. 24, 2019

(30) Foreign Application Priority Data

Jul. 20, 2017 (JP) ..... 2017-140988

(51) Int. Cl.

| | |
|---|---|
| ***H01R 13/631*** | (2006.01) |
| ***H01R 13/20*** | (2006.01) |
| ***H01R 12/91*** | (2011.01) |
| ***H01R 24/50*** | (2011.01) |
| ***H01R 13/24*** | (2006.01) |

(52) U.S. Cl.

CPC ..... *H01R 13/6315* (2013.01); *H01R 12/91* (2013.01); *H01R 13/20* (2013.01); *H01R 24/50* (2013.01); *H01R 13/2457* (2013.01)

(58) Field of Classification Search

CPC .... H01R 12/91; H01R 13/20; H01R 13/2457; H01R 13/6315; H01R 24/50

USPC ..... 439/246–248

See application file for complete search history.

(56) References Cited

U.S. PATENT DOCUMENTS

| | | | | |
|---|---|---|---|---|
| 5,516,303 A * | 5/1996 | Yohn | H01R 13/6315 | 439/248 |
| 5,718,592 A * | 2/1998 | Hosier, Sr. | H01R 24/50 | 439/63 |
| 5,769,652 A * | 6/1998 | Wider | H01R 13/6315 | 439/248 |
| 6,224,407 B1 * | 5/2001 | Duquerroy | H01R 13/6315 | 439/188 |
| 6,558,177 B2 * | 5/2003 | Havener | H01R 13/6315 | 439/246 |

(Continued)

FOREIGN PATENT DOCUMENTS

JP 2016-062661 A 4/2016

*Primary Examiner* — Oscar C Jimenez

(74) *Attorney, Agent, or Firm* — Westman, Champlin & Koehler, P.A.

(57) ABSTRACT

A connector includes: a stationary housing; a movable housing; a stationary terminal that is retained in the stationary housing; a movable terminal that includes a contact portion and that is retained in the movable housing, the contact portion of the movable terminal being configured to follow movement of the movable housing; a movable shield that follows movement of the movable housing; and a stationary shield. The movable shield and the stationary shield are in mutual contact so as to have electrical continuity. The stationary shield and the movable shield are configured to slide against one another while maintaining electrical continuity when the movable housing moves in the front-rear or the left-right direction with respect to the stationary housing.

10 Claims, 34 Drawing Sheets

(56) References Cited

U.S. PATENT DOCUMENTS

| | | | | |
|---|---|---|---|---|
| 8,512,073 | B2 * | 8/2013 | Takano | H01R 24/50<br>439/578 |
| 2009/0246990 | A1 * | 10/2009 | Yang | H01R 13/6315<br>439/135 |
| 2017/0047683 | A1 * | 2/2017 | Yanase | H01R 13/6315 |

* cited by examiner

CONNECTOR

CROSS-REFERENCE TO RELATED APPLICATION

This application claims priority under 35 USC 119 from Japanese Patent application No. 2017-140988 filed on Jul. 20, 2017, the disclosure of which is incorporated by reference herein in its entirety.

BACKGROUND

Technical Field

The present invention relates to a connector.

Related Art

Japanese Patent Application Laid-Open (JP-A) No. 2016-62661 describes one hitherto known connector.

In this document, a connector 1 includes a circular tube-shaped movable housing 52 and a terminal 7. One end of the terminal 7 is fixed to the movable housing 52 and another end of the terminal 7 is fixed to a stationary housing 51. The terminal 7 includes a spring section 63 that has an inverted U-shape.

In a connector such as this, the inverted U-shaped spring section 63 elastically deforms so as to allow the movable housing 52 to move relative to the stationary housing 51. Accordingly, even if a connection target to which the connector 1 is being connected is offset from a standard engagement position, the movable housing 52 is able to move together with one end of a terminal 3 so as to absorb this offset. This enables the connector to be configured with excellent ease of operation and connection reliability.

SUMMARY

However, in a connector such as described above, the movable housing is configured from resin, and the movable terminal positioned therein is not shielded. There is thus room for improvement with regards to the ingress and emission of electromagnetic noise.

The present invention is proposed to address issues such as the above.

Namely, an object of the present invention is to provide a connector that is capable of absorbing positional offset with respect to a connection target, that combats the ingress and emission of electromagnetic noise, and that is not liable to be damaged by concentrated stress.

A connector according to a first aspect includes a stationary housing, a movable housing, a stationary terminal, a movable terminal, a movable shield, and a stationary shield. The stationary housing is configured to be fixed to a substrate. The movable housing is capable of moving in a front-rear direction and a left-right direction with respect to the stationary housing, with the front-rear direction and the left-right direction being mutually orthogonal and running parallel to a planar surface of the substrate. The stationary terminal includes a substrate connection portion configured to be connected to the substrate, and is retained at the stationary housing. The movable terminal includes a contact portion that makes contact with a terminal portion of a connection target provided with the terminal portion and a shield connection portion, and is retained at the movable housing. The contact portion of the movable terminal is configured to follow movement of the movable housing. The movable shield makes contact with the shield connection portion of the connection target, is fixed to the movable housing so as to shield the movable terminal, and follows movement of the movable housing. The stationary shield is formed separately from the movable shield, and is configured to be fixed to the substrate. Further, the substrate connection portion and the contact portion are electrically connected to one another, the movable shield and the stationary shield are in mutual contact so as to have electrical continuity, and the stationary shield and the movable shield are configured to slide against one another while maintaining electrical continuity when the movable housing moves in the front-rear direction or the left-right direction with respect to the stationary housing.

In this aspect, the connector includes the stationary housing and the movable housing. The stationary housing is configured to be fixed to the substrate, and the movable housing is capable of moving in the front-rear direction and the left-right direction with respect to the stationary housing, with the front-rear direction and the left-right direction being mutually orthogonal and running parallel to a planar surface of the substrate.

The stationary terminal, which includes the substrate connection portion that is configured to be connected to the substrate, is retained at the stationary housing. The movable terminal, which includes the contact portion that makes contact with the terminal portion of the connection target, is retained at the movable housing. The contact portion is thereby configured to follow movement of the movable housing. Moreover, the substrate connection portion and the contact portion are electrically connected to one another.

Thus, even if the position (of the terminal portion) of the connection target with respect to the substrate is offset in a direction parallel to the planar surface of the substrate, this positional offset is able to be absorbed by the movable housing moving with respect to the stationary housing and by the contact portion also moving so as to follow the movable housing.

Note that a mode in which the substrate connection portion of the stationary terminal and the contact portion of the movable terminal are electrically connected may, for example, be one in which the stationary terminal and the movable terminal are formed together as a single terminal from the outset, or may be one in which the stationary terminal and the movable terminal are formed as separate bodies and are placed in contact with one another.

The connector also includes the movable shield that makes contact with the shield connection portion of the connection target, and the stationary shield that is formed separately from the movable shield and makes contact with the movable shield so as to have electrical continuity therewith. Further, the stationary shield and the movable shield are configured to slide against one another while maintaining electrical continuity when the movable housing moves with respect to the stationary housing in a direction parallel to the planar surface of the substrate.

Thus, even if the position (of the shield connection portion) of the connection target with respect to the substrate is offset in a direction along the planar surface of the substrate, this positional offset is able to be absorbed by the movable housing moving with respect to the stationary housing and by the movable shield moving so as to follow the movable housing. Moreover, since positional offset is absorbed by the sliding of the stationary shield and the movable shield, situations in which stress is concentrated on the shield members (the stationary shield and the movable shield), causing damage, are suppressed.

This combats the ingress and emission of electromagnetic noise, and enables the likelihood of damage to the connector caused by concentrated stress to be reduced.

A connector according to a second aspect is the first aspect, wherein the movable shield includes a tube-shaped tubular portion, and the tubular portion surrounds the movable terminal in the front-rear and left-right directions.

In this aspect, the tube-shaped tubular portion of the movable shield surrounds the movable terminal in the front-rear and left-right directions, thereby enabling the ingress and emission of electromagnetic noise to be efficiently prevented.

Note that herein, tube-shaped encompasses, for example, polygonal tube shapes as well as circular tube shapes.

A connector according to a third aspect is the second aspect, wherein there are no circumferential joints in the tubular portion of the movable shield.

In this aspect, the ingress and emission of electromagnetic noise is able to be efficiently prevented.

Namely, to surround the movable terminal, for example, the movable shield might be configured from a punched, thin metal sheet, with this thin metal sheet being made to cover the outer periphery of the movable housing. However, it is difficult to join together both end portions of the metal sheet in such a movable shield without any gaps therebetween, with the result that gaps are formed at this joint. Further, even in cases in which a recess is formed in one end portion of a metal sheet and a protrusion is formed in the other end portion of the metal sheet and these two ends are joined together, slight gaps may still be present at this joint.

However, in this aspect, the movable shield is, for example, die cast and is structured such that there are no circumferential joints in the tubular portion of the movable shield. The movable terminal is thus able to be gaplessly surrounded. This enables the ingress and emission of electromagnetic noise to be efficiently prevented.

A connector according to a fourth aspect is any one of the first aspect to the third aspect, wherein within a range of movement of the movable housing, at least one of the stationary shield or the movable shield is in an elastically deformed state at all times, and elastic force due to this elastic deformation acts along a direction placing the stationary shield and the movable shield in pressing contact so as to have electrical continuity.

In this aspect, the loss (interruption) of electrical continuity between the stationary shield and the movable shield is able to be suppressed.

Namely, when the movable housing has moved with respect to the stationary housing, in particular when the movable housing has received vibrations or a shock, there is a risk that the stationary shield and the movable shield will lose contact with each other and that noise will be emitted from the movable shield and the stationary shield.

However, in this aspect, within the range of movement of the movable housing, at least one of the stationary shield or the movable shield is in an elastically deformed state at all times, and this elastic force acts along a direction placing the stationary shield and the movable shield in pressing contact so as to have electrical continuity.

This enables the loss (interruption) of electrical continuity between the stationary shield and the movable shield to be suppressed after the receipt of vibration or shock, enabling the connector to be well-equipped to handle noise.

A connector according to a fifth aspect is the connector of any one of the first aspect to the fourth aspect wherein: the movable shield includes a limited portion; the stationary shield includes an elastic spring section, and a limiting portion that abuts the limited portion so as to limit a range of movement of the movable housing toward one up-down direction side; the elastic spring section includes a stationary-side contact portion that makes contact with the other up-down direction side of the limited portion, and an elastic support portion that elastically supports the stationary-side contact portion and extends in a direction along the planar surface of the substrate; and the elastic support portion causes the stationary-side contact portion to make pressing contact with the limited portion even in a state in which the limited portion has abutted the limiting portion.

In this aspect, a stable connection to ground is maintained even when the movable housing moves with respect to the stationary housing.

Namely, in this aspect, the movable shield includes the limited portion, the stationary shield includes the limiting portion, and the limited portion abuts the limiting portion so as to limit the range of movement of the movable housing toward one up-down direction side (upward or downward).

The stationary-side contact portion of the elastic spring section of the stationary shield makes contact with the limited portion of the movable shield from the other up-down direction side. The stationary-side contact portion is elastically supported by the elastic support portion of the elastic spring section of the stationary shield. Further, the elastic support portion causes the stationary-side contact portion to make pressing contact with the limited portion even in a state in which the limited portion has abutted the limiting portion.

The limited portions of the movable shield are thus sandwiched between the limiting portion and the stationary-side contact portion of the stationary shield in the up-down direction so as to make pressing contact therewith and provide stable electrical continuity between the stationary shield and the movable shield.

Further, since the elastic support portion extends in a direction along the planar surface of the substrate, the elastic support portion is able to be formed longer. This suppresses the concentration of stress on the elastic support portion of the stationary shield, and as a result suppresses damage.

A connector according to a sixth aspect is the connector of fifth aspect, wherein: the limiting portion is an upper limiting portion that abuts the limited portion from an upper side so as to limit a range of upward movement of the movable housing; the stationary housing includes a limiting face portion that abuts the limited portion from a lower side so as to limit a range of downward movement of the movable housing, and a recess that is formed in the limiting face portion; and the stationary-side contact portion is pressed by the limited portion and fits into the recess when the limited portion approaches the limiting face portion.

In this aspect, the likelihood of damage to the elastic spring section of the stationary shield is able to be reduced.

Namely, were the elastic spring section to be used to abut the limited portion of the movable shield from the lower side and limit downward movement of the movable housing during downward movement of the movable housing, the elastic spring section would be at risk of plastically deforming and snapping due to being unable to cope with the pressing force received.

However, in this aspect, the upper limiting portion of the stationary shield limits movement when the movable housing moves upward, and the limiting face portion of the stationary housing limits movement when the movable housing moves downward. This prevents excessive load from acting on the stationary shield. Thus, damage to the elastic spring section of the stationary shield is able to be suppressed.

Further, even while the limiting face portion abuts the limited portion, the stationary-side contact portion of the elastic spring section continues to press the limited portion upward through an opening in the recess despite being fitted inside the recess. This enables the electrical continuity between the stationary shield and the movable shield to be stably maintained.

A connector according to a seventh aspect is fifth aspect, wherein: the limiting portion is an upper limiting portion that abuts the limited portion from an upper side so as to limit a range of upward movement of the movable housing; and the limited portion includes a sloped face protruding upward at a portion that abuts the upper limiting portion.

In this aspect, the upper limiting portion abuts the sloped face protruding upward at the limited portion so as to limit the range of upward movement of the movable housing. This permits the movable housing to tilt by a large amount without increasing the range of motion of the movable housing in the up-down direction.

A connector according to an eighth aspect is any one of the first aspect to the seventh aspect, wherein: the movable shield includes a limited portion; the stationary housing includes a limiting face portion that abuts the limited portion from a lower side so as to limit a range of downward movement of the movable housing; and the limiting face portion includes a sloped face protruding upward.

In this aspect, the sloped face protruding upward at the limiting face portion of the stationary housing abuts the limited portion of the movable shield from the lower side so as to limit the range of downward movement of the movable housing. This permits the movable housing to tilt by a large amount without increasing the range of motion of the movable housing in the up-down direction.

A connector according to an ninth aspect is any one of the first aspect to the eighth aspect, wherein the stationary shield is configured by a member made by bending a punched sheet blank, and a smooth face of the stationary shield, rather than a punch-sheared face of the stationary shield, makes contact with the movable shield so as give electrical continuity to the stationary shield and the movable shield.

In this aspect, a smooth face of the stationary shield, rather than a punch-sheared face of the stationary shield, makes contact with the movable shield so as give electrical continuity between the stationary shield and the movable shield. The stationary shield is thus manufactured by punching and bending. Friction between the stationary shield and the movable shield is suppressed, and stable electrical continuity can be achieved between the stationary shield and the movable shield.

As described above, the present invention has the excellent advantageous effect of enabling positional offset with respect to a connection target to be absorbed, and moreover combats the ingress and emission of electromagnetic noise, and is not liable to be damaged by concentrated stress.

BRIEF DESCRIPTION OF THE DRAWINGS

Exemplary embodiments will be described in detail with reference to the following figures, wherein.

DETAILED DESCRIPTION

Figure 1A:
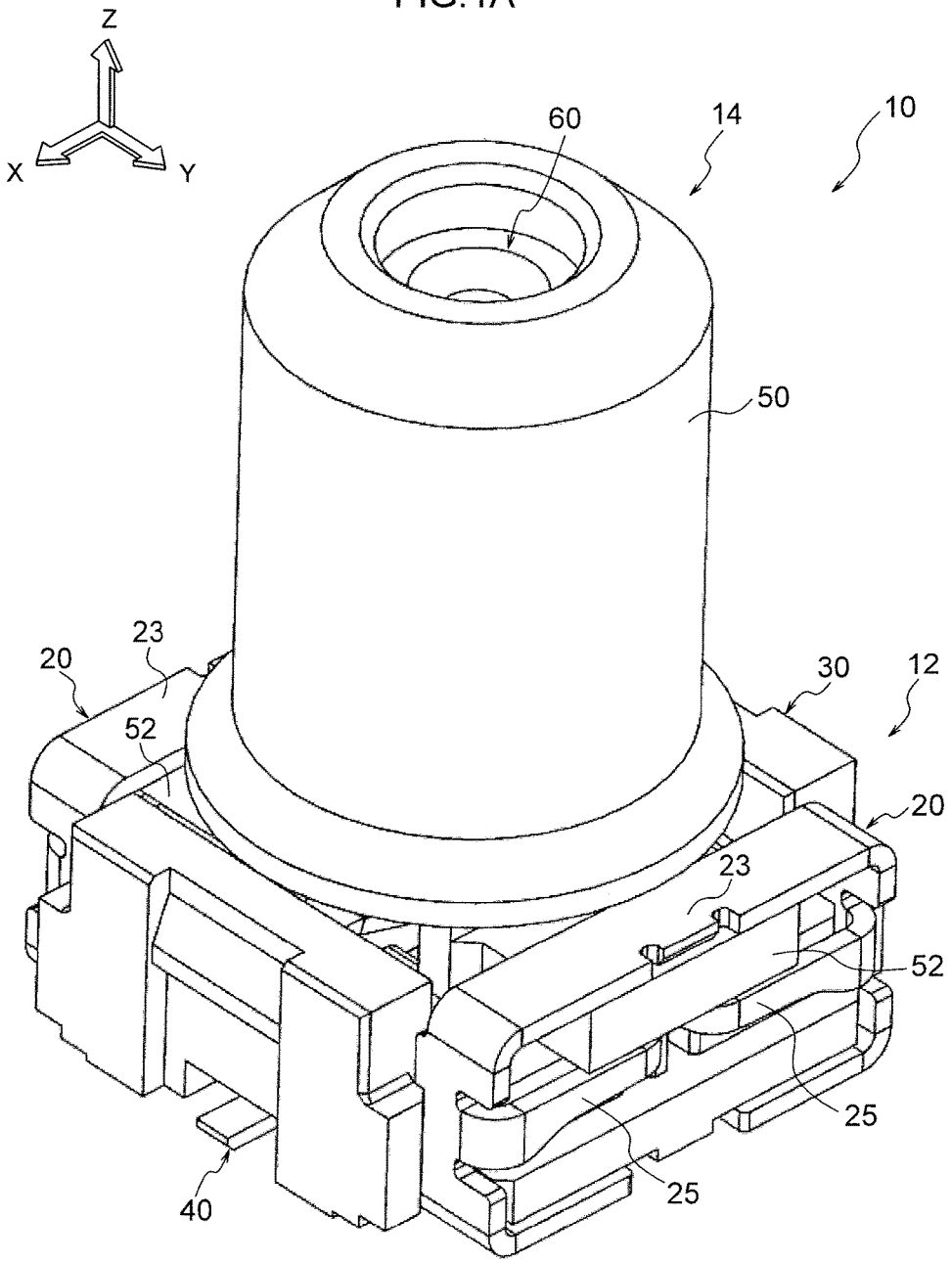
FIG. 1A is a perspective view of an assembled connector.
Figure 1B:
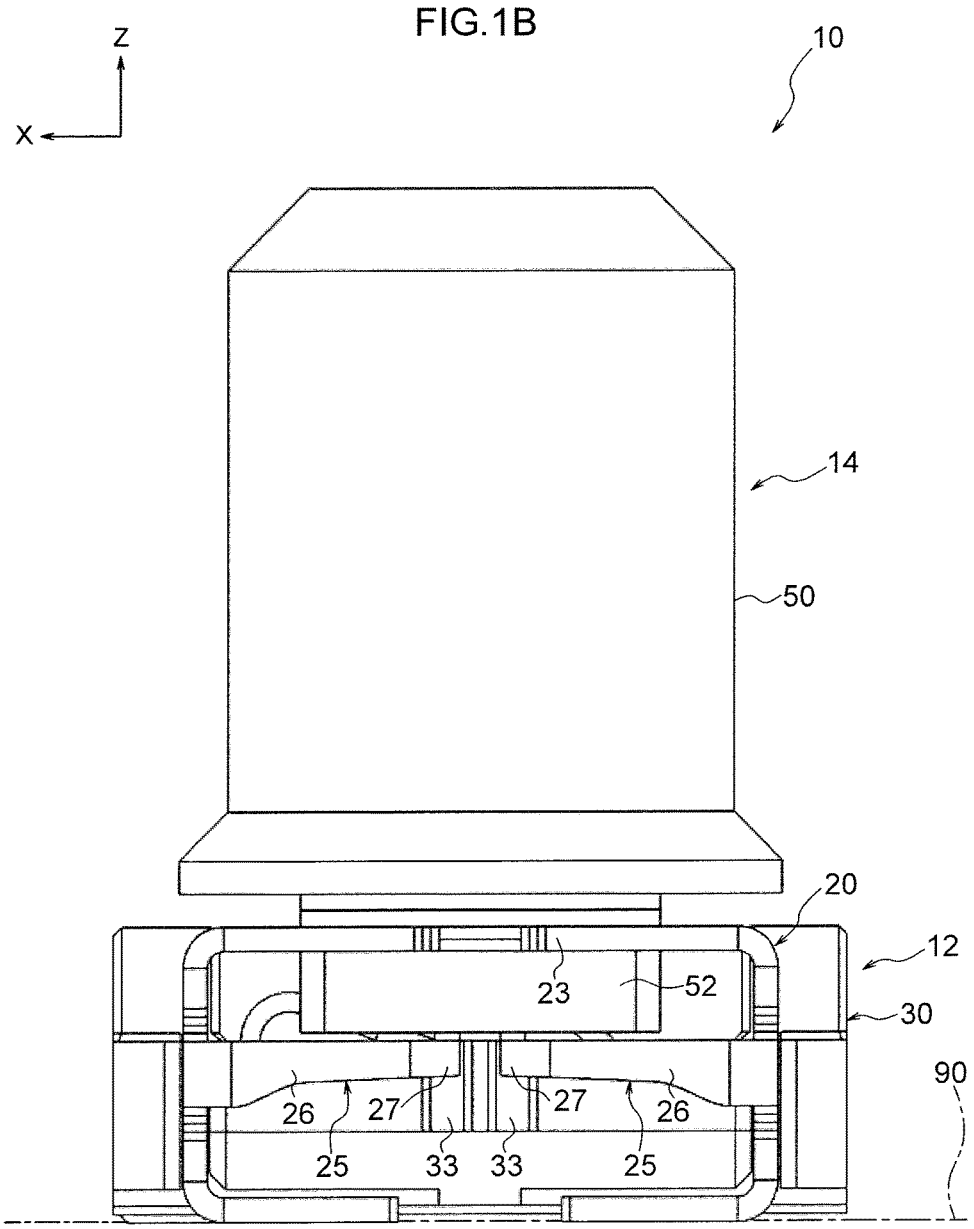
FIG. 1B is a side view of an assembled connector.
Figure 1C:
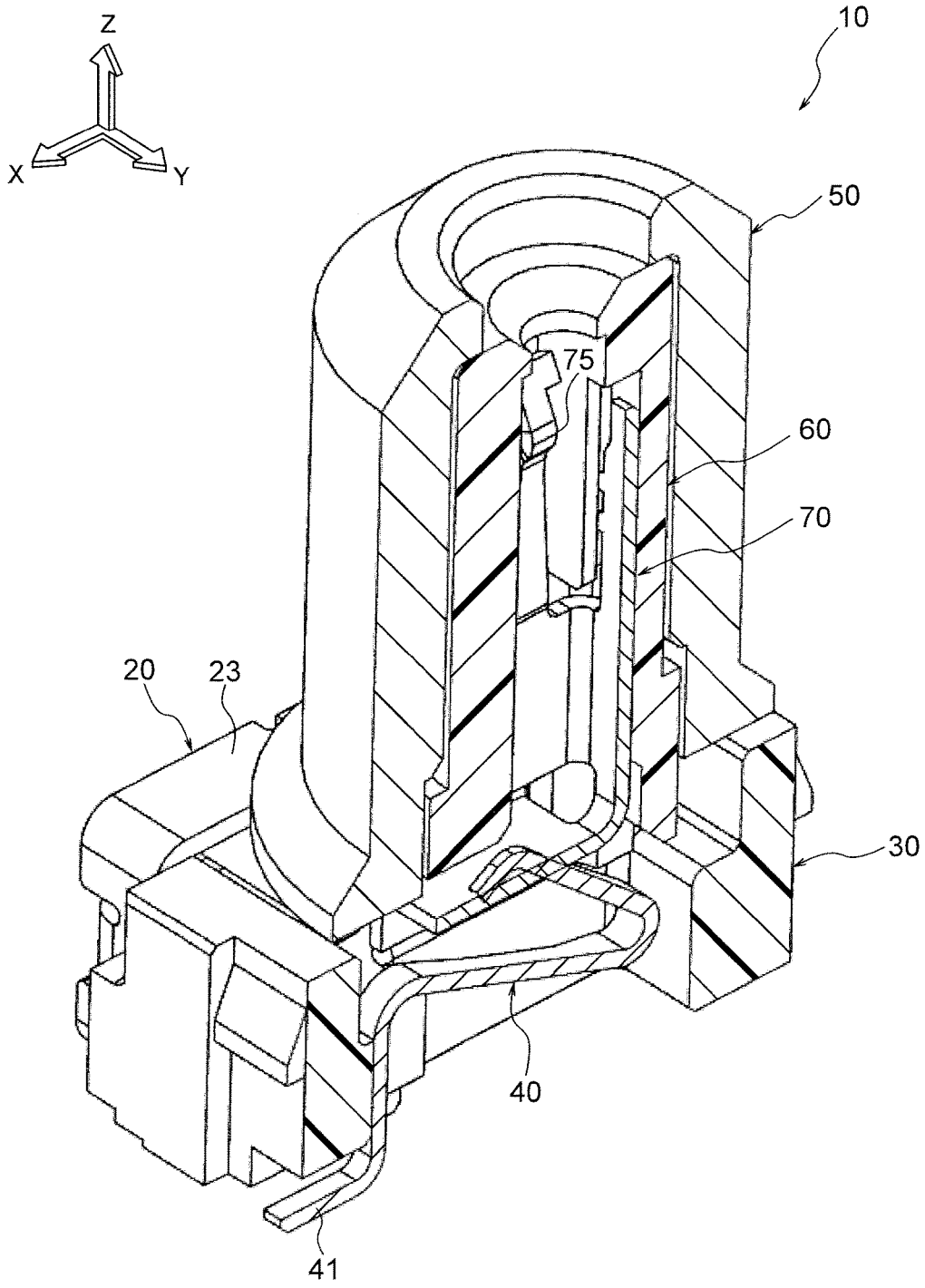
FIG. 1C is a perspective view cross-section of an assembled connector taken along a plane orthogonal to a connector width direction.

Explanation follows regarding an exemplary embodiment of the present invention.

Note that the arrows X, Y, and Z illustrated in the drawings are respectively used to indicate a connector front direction, one side (a left side) in a connector width direction, and a connector upward direction in the following explanation. Further, unless specifically stated otherwise, the terms front-rear, up-down, and width (left-right) are used to indicate front-rear in a connector front-rear direction, up-down in a connector up-down direction, and width (left-right) in the connector width direction (left-right direction).

Overview

FIG. 1A to FIG. 1E illustrate a connector 10 of an exemplary embodiment in an assembled state. FIG. 1F illustrates the connector 10 in an exploded state.

The connector 10 is broadly configured by a stationary-side member 12 that is fixed to a substrate 90 (see FIG. 1B, FIG. 1E) and a movable-side member 14 that is capable of moving through a given range of motion with respect to the stationary-side member 12.

Figure 2A:
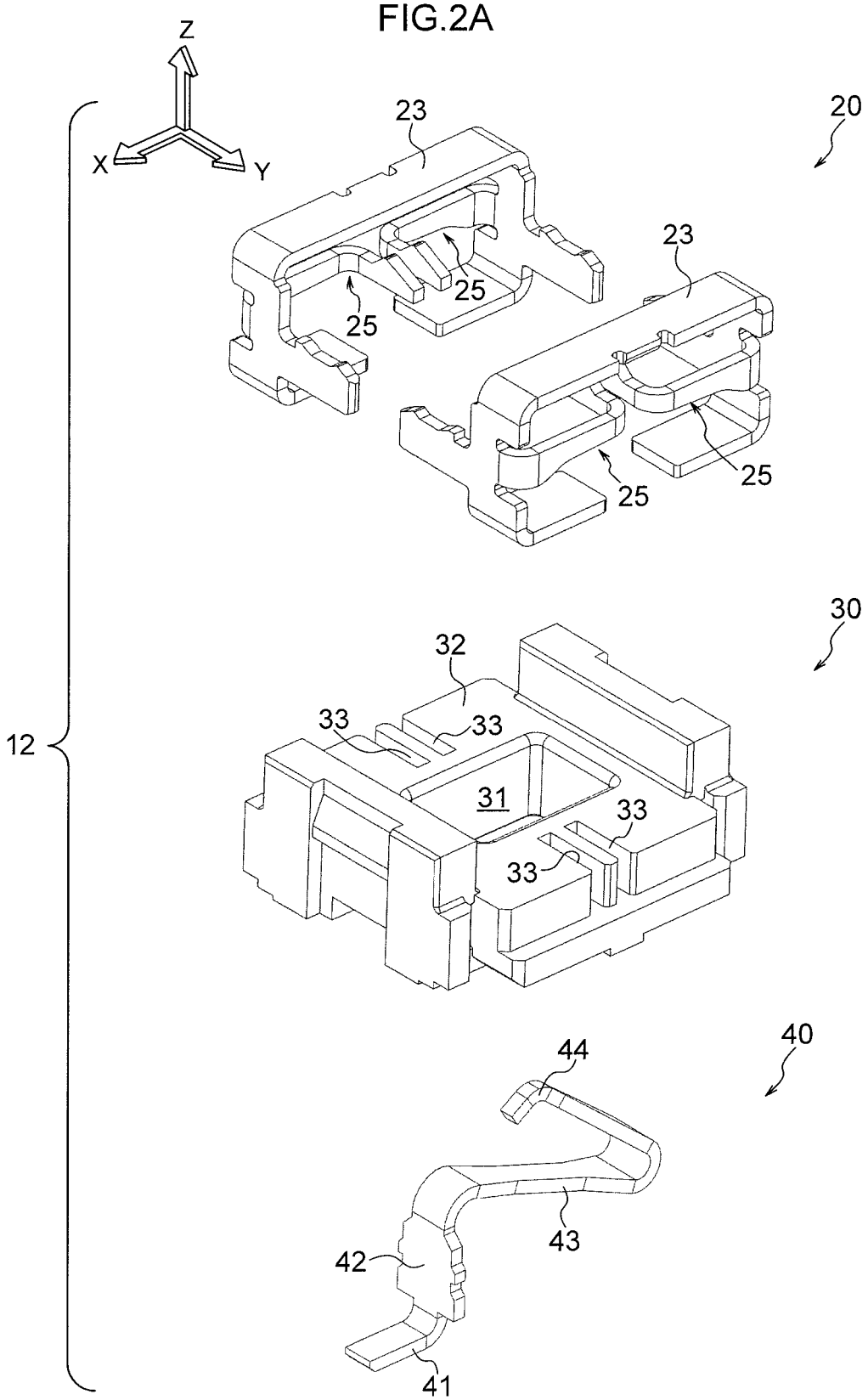
FIG. 2A is an exploded perspective view of stationary-side member.
Figure 3A:
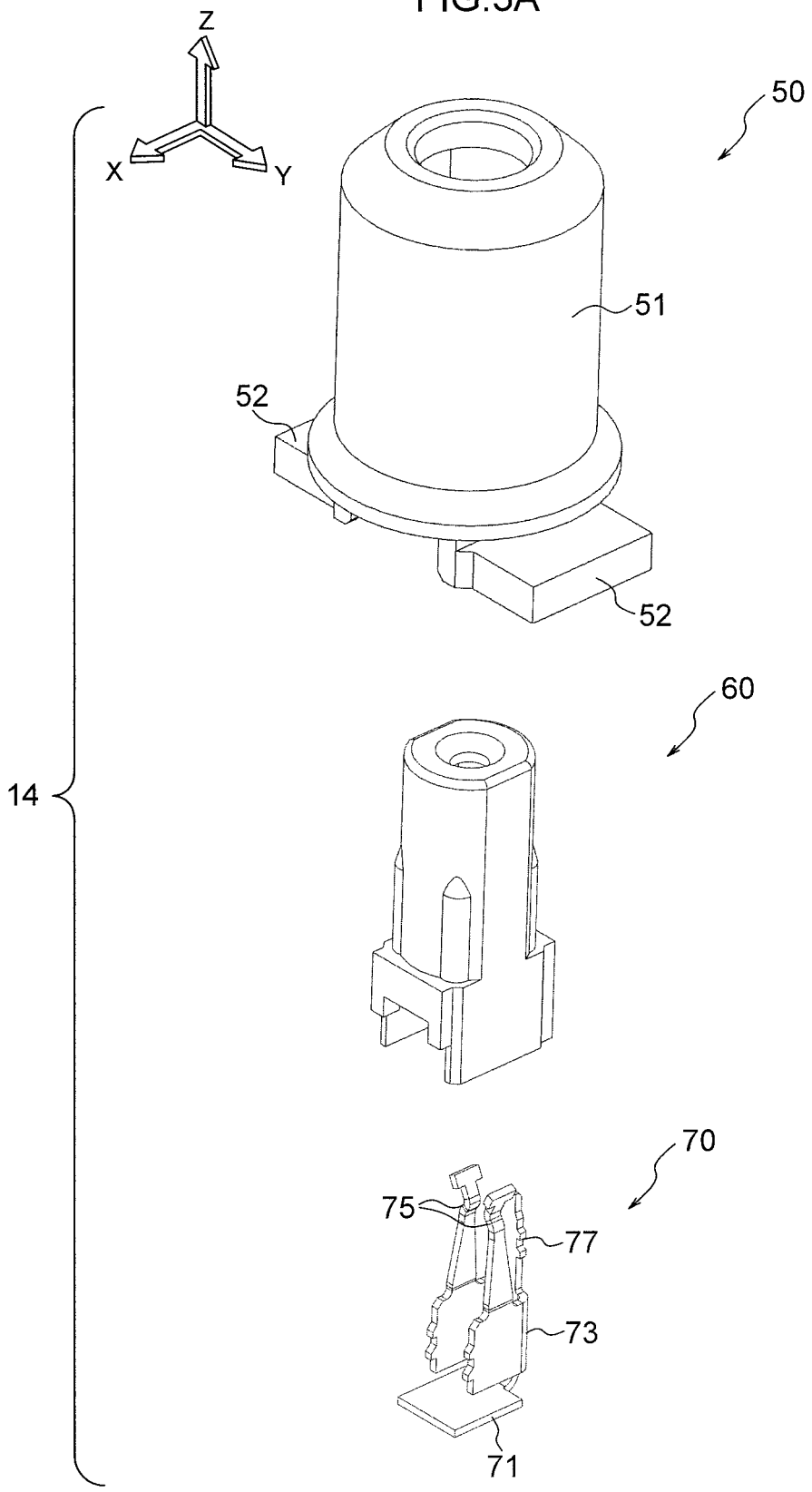
FIG. 3A is an exploded perspective view of a movable-side member.

As illustrated in FIG. 2A, the stationary-side member 12 is configured by clips 20, a stationary housing 30, and a stationary terminal 40. As illustrated in FIG. 3A, the movable-side member 14 is configured by a movable shield 50, a movable housing 60, and a movable terminal 70.

When the connector 10 is in an assembled state, portions of the stationary terminal 40 and the clips 20 (elastic spring sections 25), for example, are elastically deformed. However, in the figures, (for example FIG. 1C to FIG. 1E), each of these components is illustrated in a free state (a state not elastically deformed) for the sake of simplicity. Sections where such components are illustrated overlapping with one another indicate places where, in practice, one or both of these overlapping components is elastically deformed.

Detailed explanation follows regarding the configuration of various portions.

Stationary Housing 30

Figure 2B:
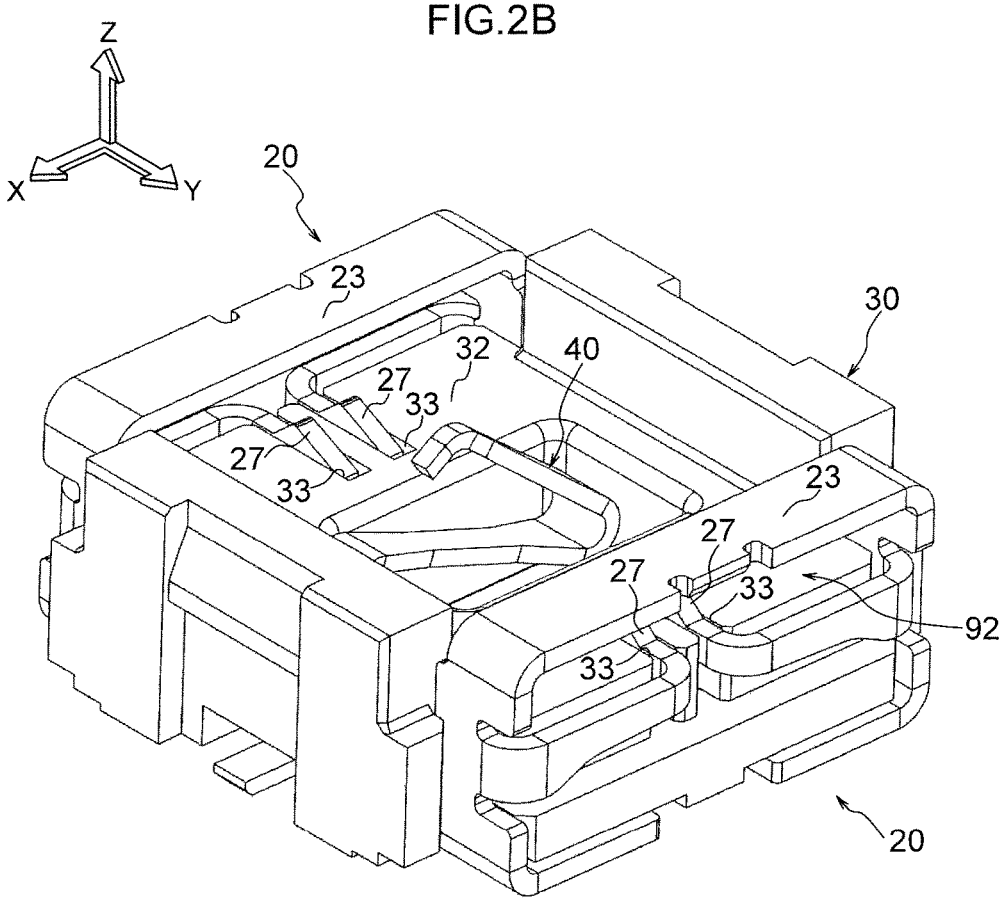
FIG. 2B is a perspective view of a stationary-side member.

FIG. 6A to FIG. 6D illustrate the stationary housing 30. The stationary housing 30 is a member that is fixed to the substrate 90. Specifically, as illustrated in FIG. 2B, the stationary housing 30 is fixed to the substrate 90 by two clips 20. The stationary housing 30 is configured from an insulator such as a synthetic resin.

The stationary housing 30 includes a terminal-retaining portion 31 that retains the stationary terminal 40. The terminal-retaining portion 31 is configured by a through hole that passes through the stationary housing 30 in the up-down direction. The stationary terminal 40 is retained in the terminal-retaining portion 31 of the stationary housing 30 by pressing the stationary terminal 40 into the stationary housing 30 from below, as illustrated in FIG. 1F and FIG. 4A to FIG. 4C.

Figure 6A:
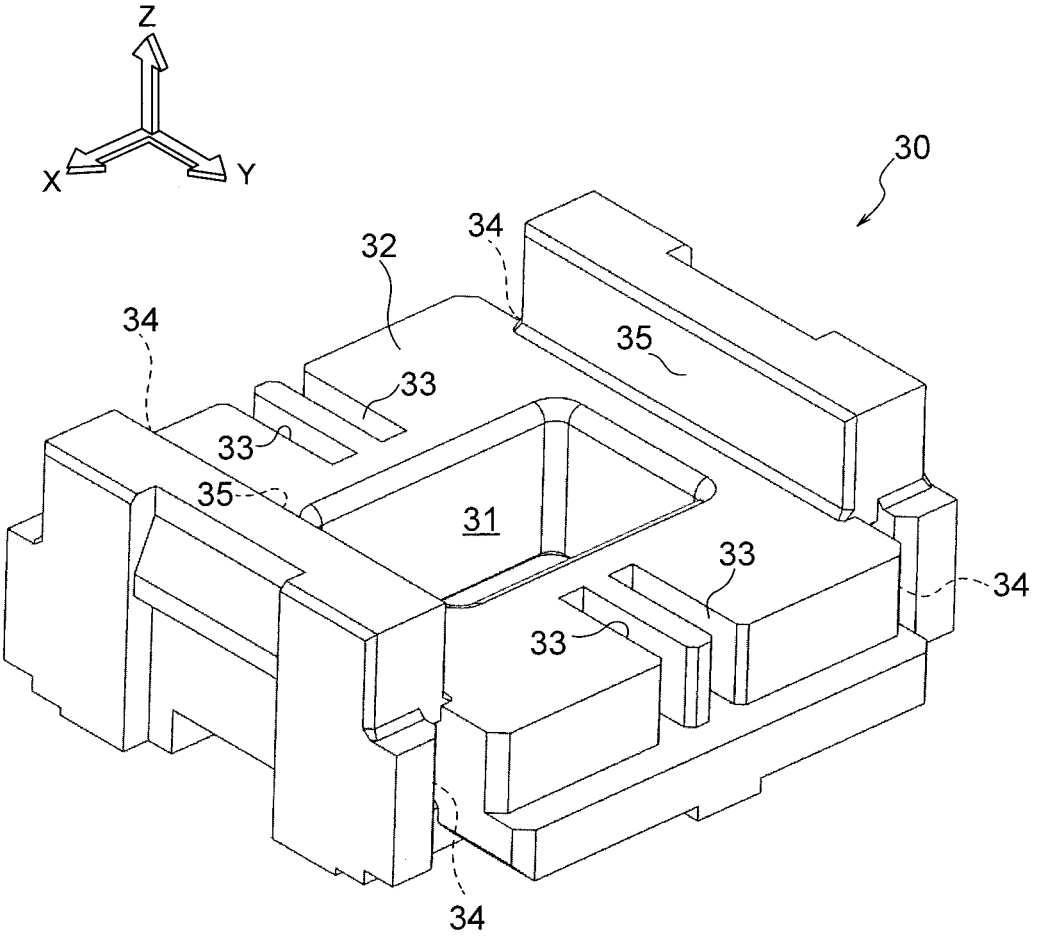
FIG. 6A is a perspective view of a stationary housing.
Figure 6B:
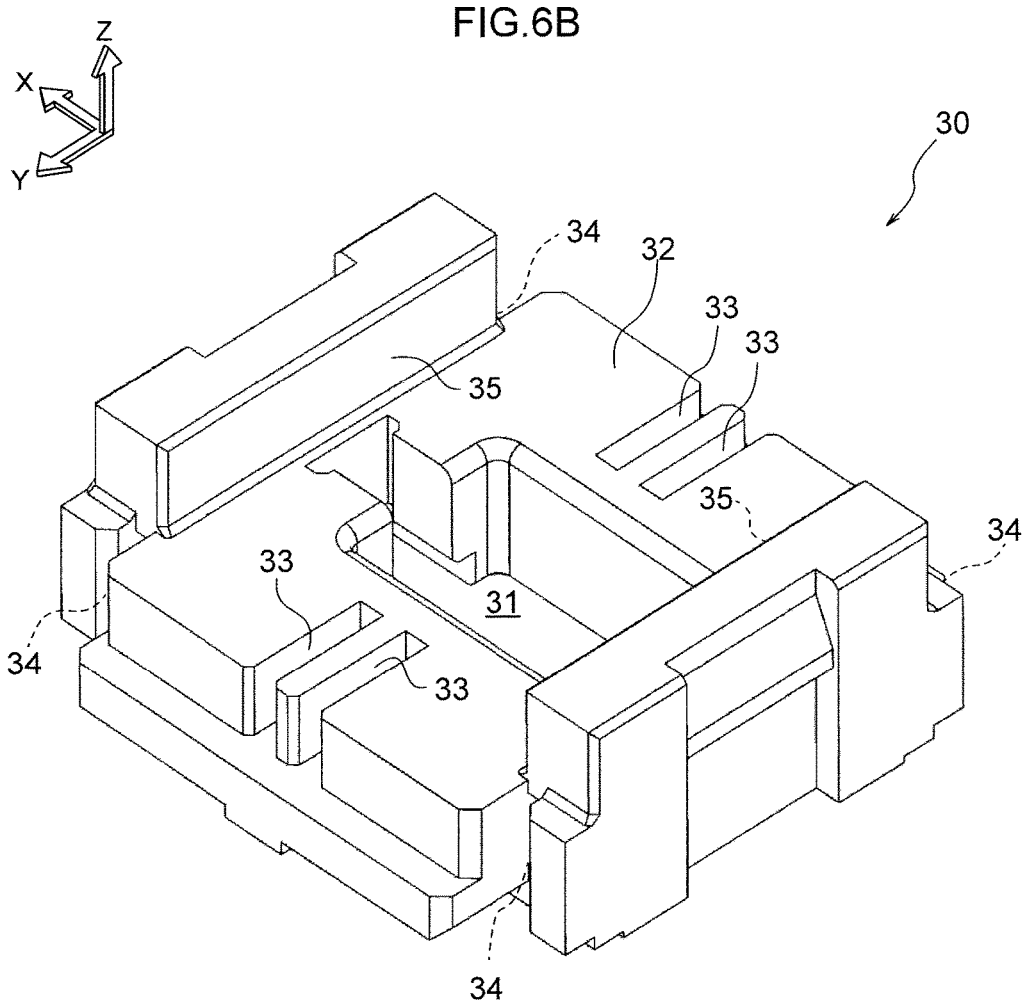
FIG. 6B is a perspective view of a stationary housing as seen from another angle.
Figure 6C:
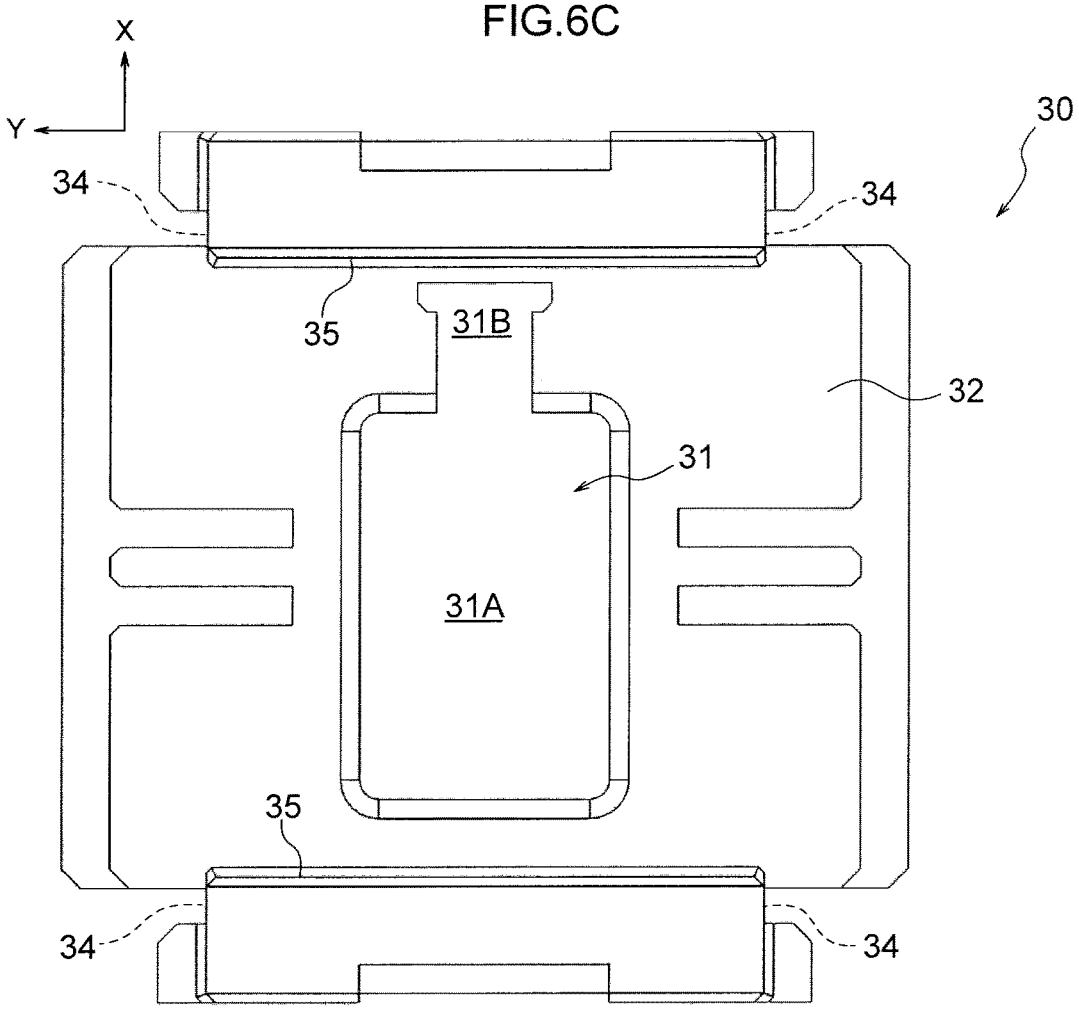
FIG. 6C is a plan view of a stationary housing.
Figure 6D:
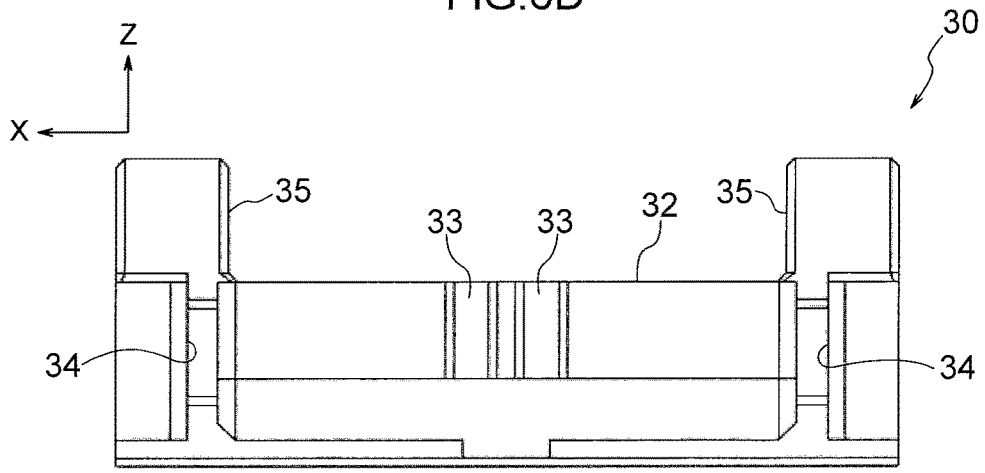
FIG. 6D is a side view of a stationary housing.

As illustrated in FIG. 6C, the terminal-retaining portion 31 is configured by a main body portion 31A that has a substantially rectangular shape in plan view, and by a press-fit portion 31B that widens toward the front from a width direction center of the main body portion 31A. The main body portion 31A has a rectangular shape with its length direction running along the front-rear direction in plan view. The press-fit portion 31B is a portion formed with a smaller width than the main body portion 31A. A front end portion of the press-fit portion 31B is formed slightly wider than the rest of the press-fit portion 31B, and a fixed portion 42 of the stationary terminal 40 is press fitted therein (see FIG. 4C).

The stationary housing 30 includes a limiting face portion 32 that abuts part of the movable-side member 14 (limited portions 52 of the movable shield 50) so as to limit the range of downward movement of the movable-side member 14. The limiting face portion 32 is the face on the upper side of the stationary housing 30, and is a planar surface having a normal pointing in an upward direction. The limiting face portion 32 extends in the front-rear direction and the left-right direction from the upper edge of the terminal-retaining portion 31 through hole.

Recesses 33 are formed in the limiting face portion 32 into which stationary-side contact portions 27 of the clips 20 are fit in (see FIG. 2B). The recesses 33 are formed set downward from the limiting face portion 32, and are open at the upper side. In addition to at the upper side, the recesses 33 are also open at the width direction outsides thereof. The recesses 33 are formed in both the left and right sides of the stationary housing 30, with two recesses 33 being formed in each left and right side for a total of four recesses 33.

The stationary housing 30 includes clip holders 34 for combining the stationary housing 30 and the clips 20 into a single unit. Plural of the clip holders 34 (four, in the present exemplary embodiment) are formed. The clip holders 34 are formed in the vicinity of the four corners of the stationary housing 30 that has a substantially rectangular shape in plan view. The clip holders 34 are holes that open toward the width direction outside of the stationary housing 30. Two press-fit portions 24 of a clip 20 are press fitted into the two right-side clip holders 34 from the right side of the stationary housing 30, and two press-fit portions 24 of a clip 20 are press fitted into the two left-side clip holders 34 from the left side of the stationary housing 30. The clips 20 and the stationary housing 30 are thereby combined into a single unit.

The stationary housing 30 further includes front and rear upright face portions 35. The upright face portions 35 are faces that extend upward from a front end and a rear end of the limiting face portion 32. The upright face portions 35 are planar surfaces that have normals pointing in directions toward the front-rear direction center.

Clips 20

Figure 7A:
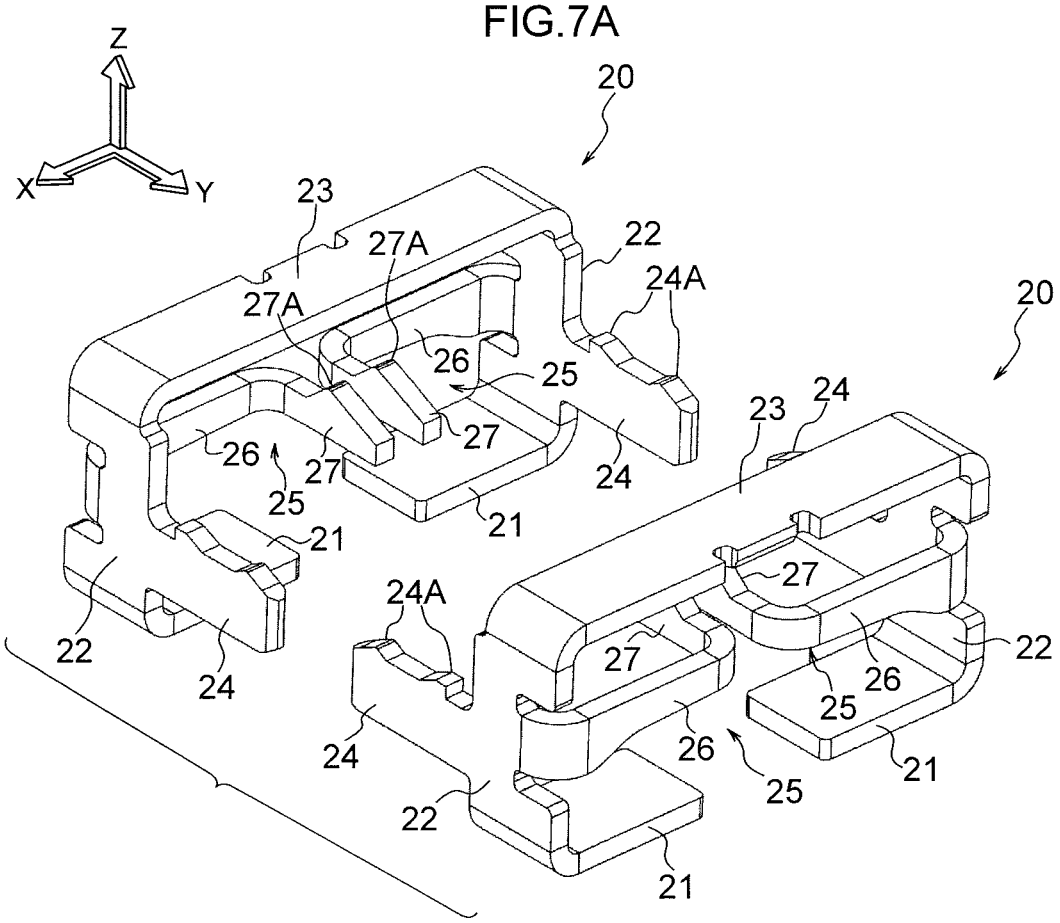
FIG. 7A is a perspective view of clips.
Figure 7B:
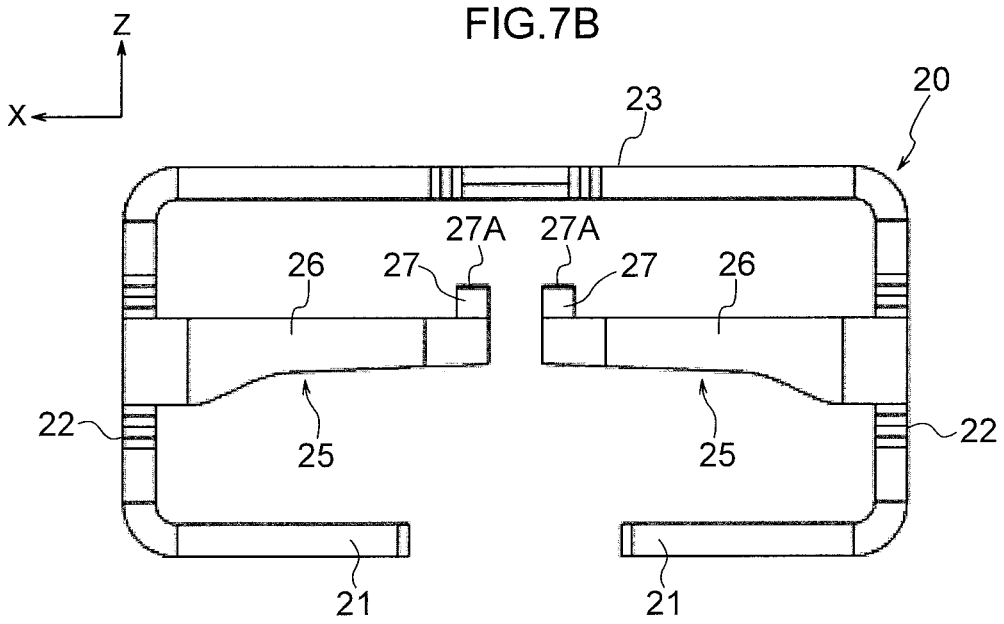
FIG. 7B is a side view of a clip.

FIG. 7A illustrates two of the clips 20. The clips 20 are components for fixing the stationary housing 30 to the substrate 90. The clips 20 are also members for limiting the range of movement of the movable-side member 14. The clips 20 further function as a stationary shield for grounding the movable shield 50 that shields the movable terminal 70.

The clips 20 include substrate-fixed portions 21 that are soldered and fixed to the substrate 90 and that ground the clips 20. The substrate-fixed portions 21 are oriented with their plate thickness directions in the up-down direction, and are formed in front-rear pairs. A front vertical wall portion 22 is formed extending upward from a front end of the front substrate-fixed portion 21, and a rear vertical wall portion 22 is formed extending upward from a rear end of the rear substrate-fixed portion 21. The vertical wall portions 22 are oriented with their plate thickness directions in the front-rear direction.

The clips 20 each include an upper wall portion 23. The upper wall portions 23 link together upper ends of the front and rear vertical wall portions 22 along the front-rear direction. Each upper wall portion 23 is oriented with its plate thickness direction in the up-down direction. The upper wall portions 23 abut part of the movable-side member 14 (limited portions 52 of the movable shield 50), thereby functioning as upper limiting portions that limit the range of upward movement of the movable-side member 14.

The clips 20 each include front and rear press-fit portions 24 for combining the clips 20 and the stationary housing 30 into a single unit. The press-fit portions 24 extend toward a connector width direction center from up-down direction intermediate portions of the front and rear vertical wall portions 22. The press-fit portions 24 are configured with their plate thickness directions in the connector front-rear direction. Latching projections 24A are formed on one plate width direction side (connector upper side) of each press-fit portion 24. The press-fit portions 24 are press fitted into the clip holders 34 of the stationary housing 30.

The clips 20 each include elastic spring sections 25. A front and rear pair of the elastic spring sections 25 extend from up-down direction intermediate portions of the front and rear vertical wall portions 22. Each elastic spring section 25 is configured by an elastic support portion 26 and a stationary-side contact portion 27.

Figure 1D:
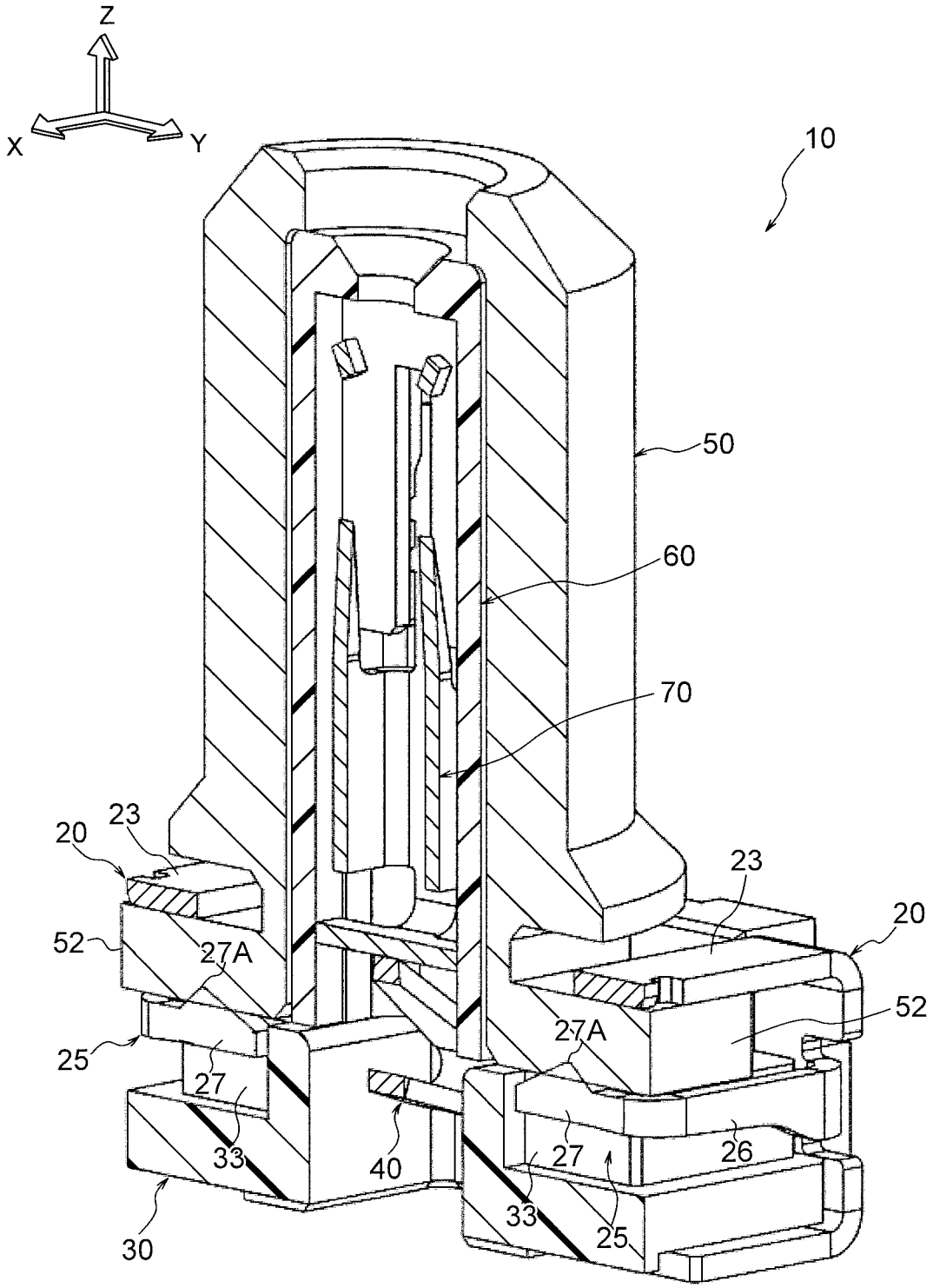
FIG. 1D is a perspective view cross-section of an assembled connector taken along a plane orthogonal to a connector front-rear direction.

The elastic support portions 26 elastically support the stationary-side contact portions 27, and the stationary-side contact portions 27 elastically contact part of the movable-side member 14 (limited portions 52 of the movable shield 50) from the lower side (see FIG. 1D). The elastic support portions 26 extend along the connector front-rear direction toward the connector front-rear direction center. The stationary-side contact portions 27 extend from leading ends of the elastic support portions 26 toward the connector width direction center. The elastic support portions 26 and the stationary-side contact portions 27 are both oriented with their plate thickness directions in a connector horizontal direction, and a bent portion is formed between respective elastic support portions 26 and stationary-side contact portions 27. The stationary-side contact portions 27 are oriented with their plate thickness directions in the connector front-rear direction. The plate width of each stationary-side contact portion 27 varies according to position along the extension direction thereof, with an apex 27A that protrudes upward being formed by the variations in plate width.

The plate width dimension (connector up-down dimension) of each elastic support portion 26 is largest in the vicinity of the base of each elastic support portion 26, and the plate width dimension of each elastic support portion 26 is smallest in the vicinity of the leading end of each elastic support portion 26. The portion of each vertical wall portion 22 where the respective elastic spring section 25 extends therefrom has a smaller plate width dimension (connector width direction). Specifically, the connector width direction outside portion of each vertical wall portion 22 is set back toward the connector width direction inside.

Figure 2C:
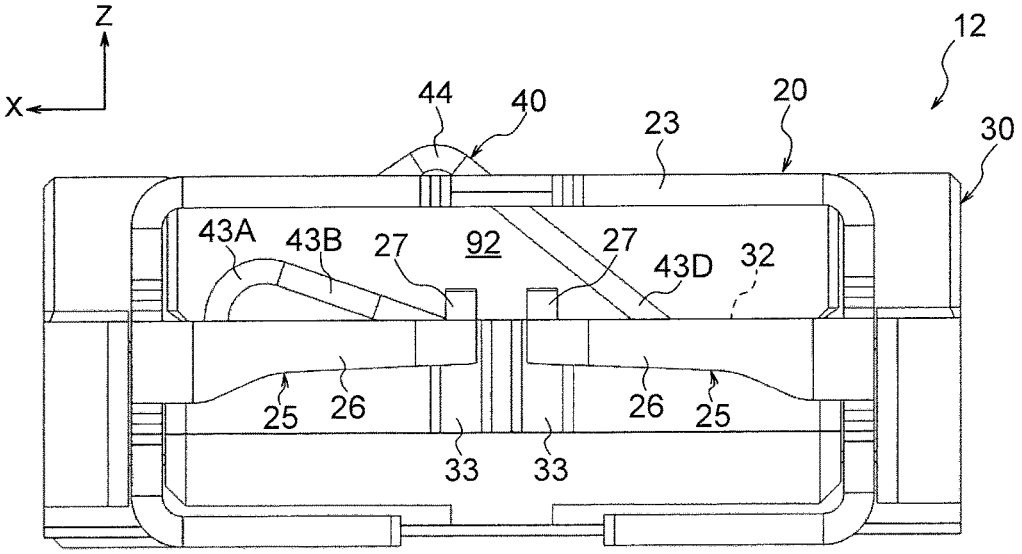
FIG. 2C is a side view of a stationary-side member.
Figure 2D:
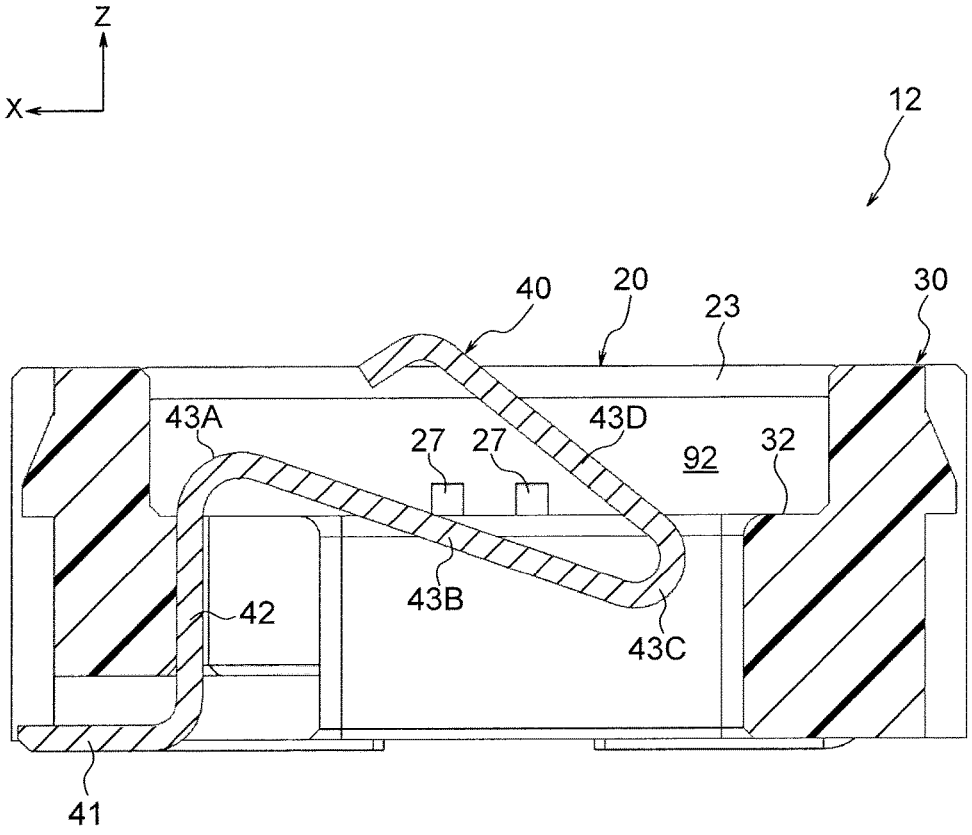
FIG. 2D is a side view cross-section of a stationary-side member.

As illustrated in FIG. 2C and FIG. 2D, a gap 92 is formed between the limiting face portion 32 of the stationary housing 30 and the upper wall portions 23 of the left and right clips 20.

Stationary Terminal 40

Figure 5A:
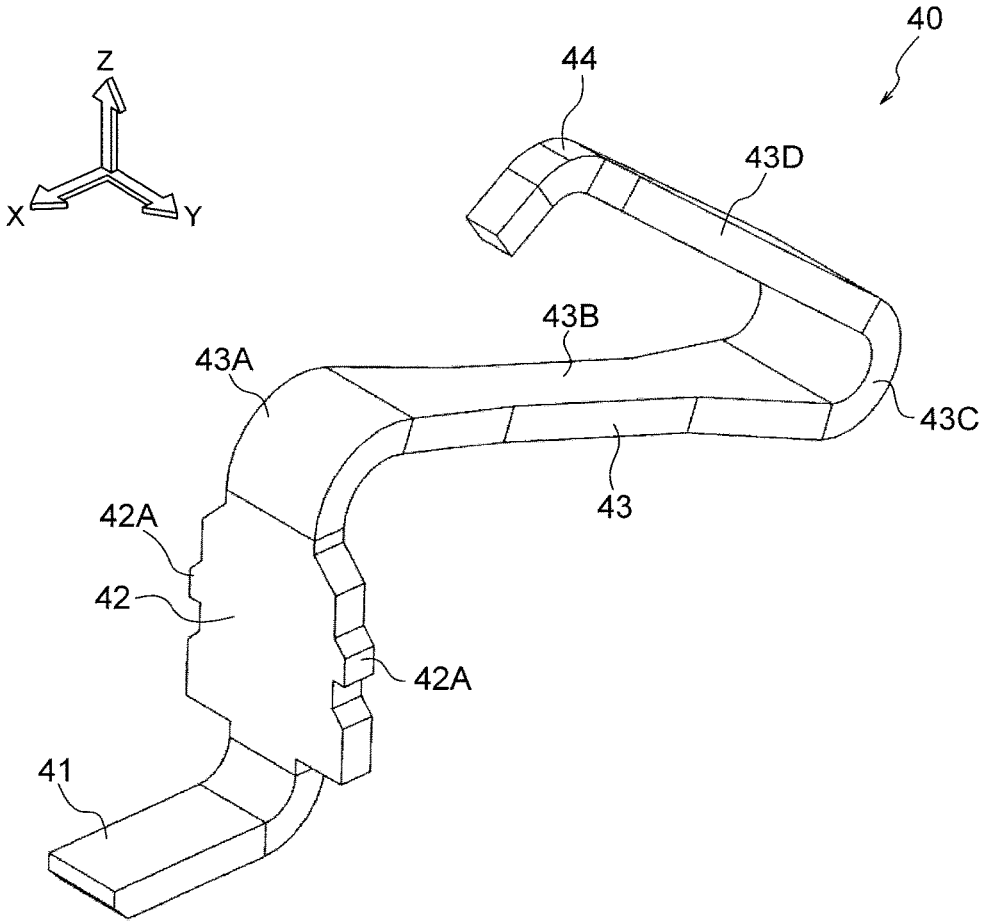
FIG. 5A is a perspective view of a stationary terminal.
Figure 5B:
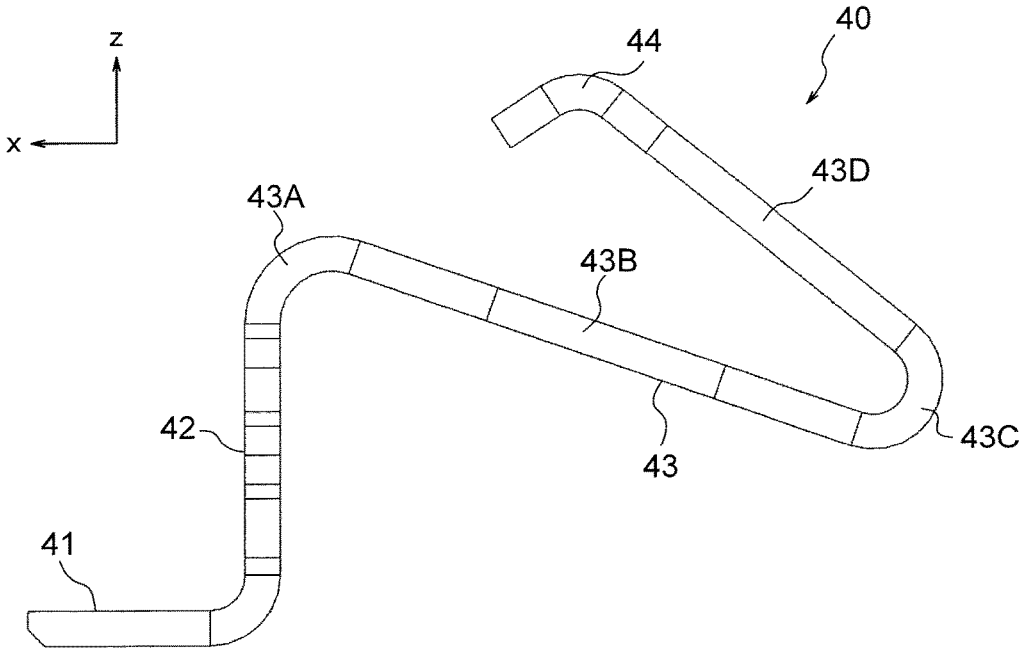
FIG. 5B is a side view of a stationary terminal.

FIG. 5A and FIG. 5B illustrate the stationary terminal 40. The stationary terminal 40 is a signal terminal. A metal sheet blank is punched, and then bent, to form the stationary terminal 40. Accordingly, the front face and the rear face (the faces on either side in the plate thickness direction) of the stationary terminal 40 are configured by smoother faces than faces that are formed by punching (faces connecting the front face and the rear face to one another, punch-sheared faces). In the present specification, the front face and the rear face of the stationary terminal 40 are referred to as smooth faces. In the following, of the smooth faces of the stationary terminal 40, the smooth face on the side that makes contact with the movable terminal 70 is the front face, and the smooth face on the opposite side is the rear face.

In sequence from one end to the other, the stationary terminal 40 includes a substrate connection portion 41, a fixed portion 42, a spring section 43, and a stationary-side sliding portion 44.

The substrate connection portion 41 is a portion that is connected to a land pattern on the substrate 90 through soldering or the like. The substrate connection portion 41 is oriented with its plate thickness direction in the up-down direction, and extends rearward from one end to the other.

Figure 4A:
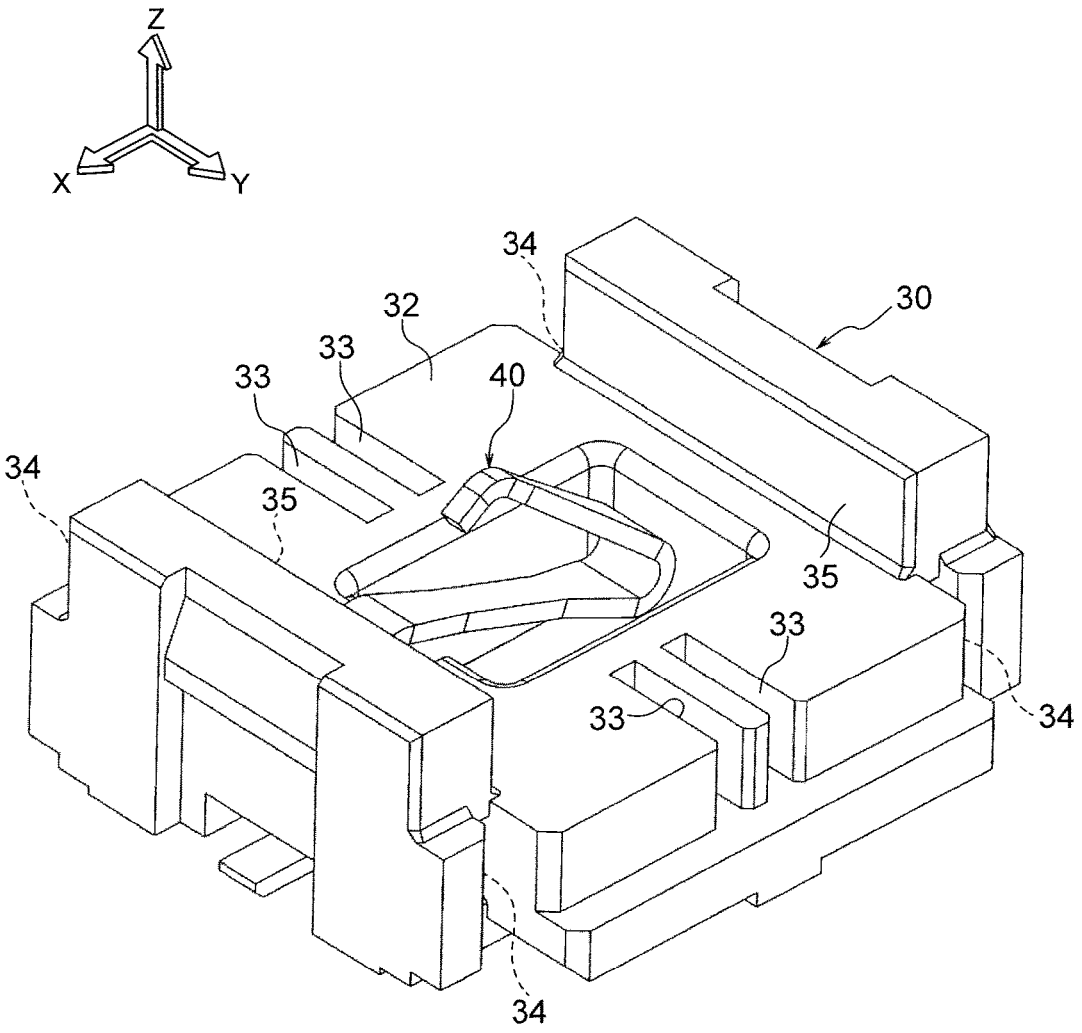
FIG. 4A is a perspective view illustrating a state in which a stationary terminal is retained in a stationary housing.
Figure 4B:
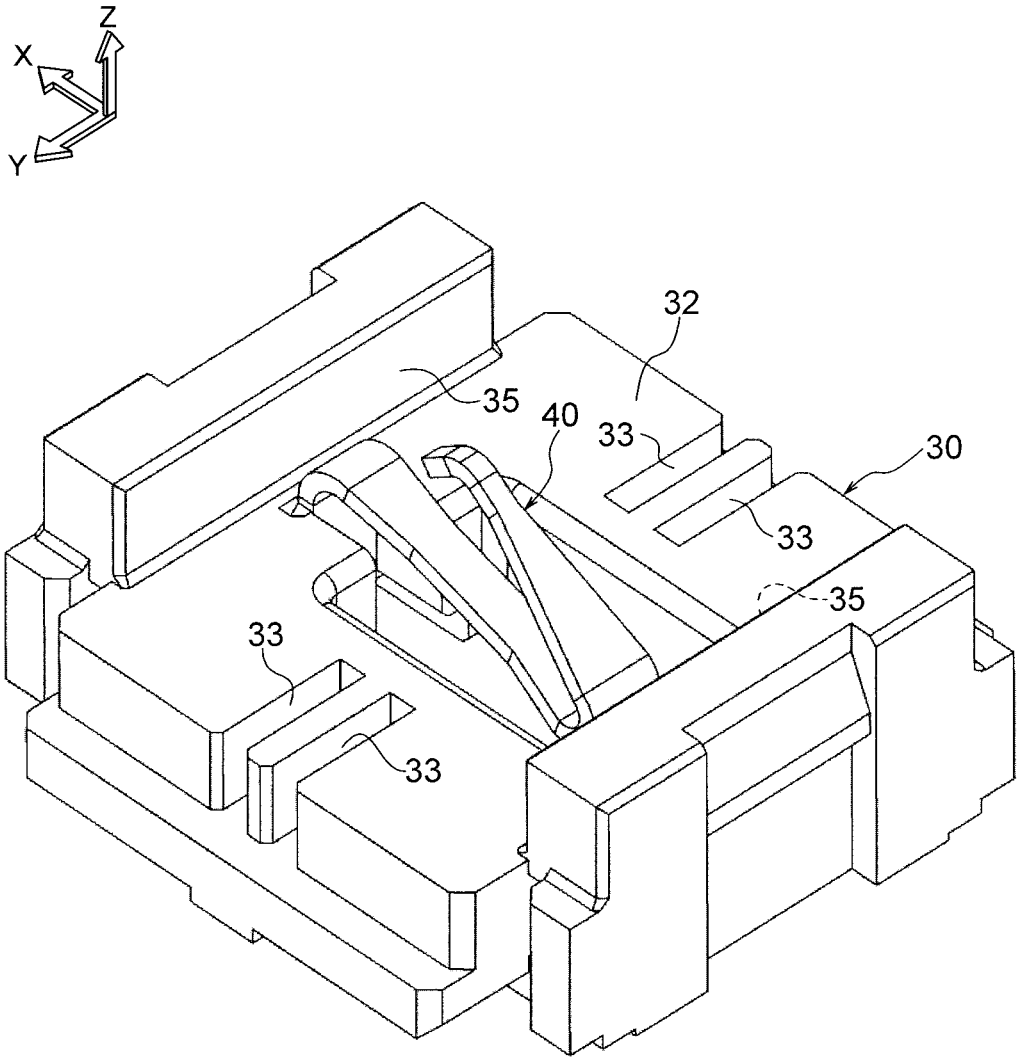
FIG. 4B is a perspective view illustrating a state in which a stationary terminal is retained in a stationary housing from another angle.
Figure 4C:
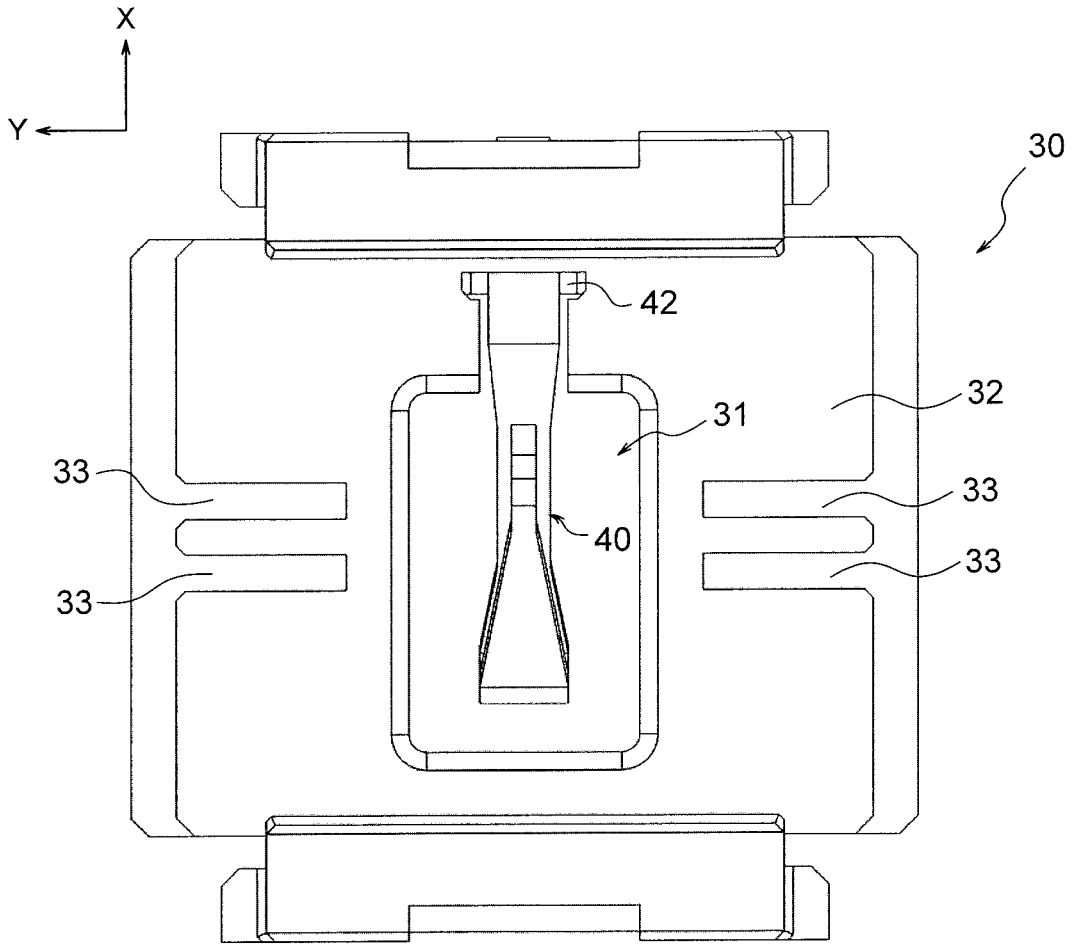
FIG. 4C is a plan view illustrating a state in which a stationary terminal is retained in a stationary housing.

The fixed portion 42 is a portion that is press-fitted into and fixed to the press-fit portion 31B of the stationary housing 30 (see FIG. 6C, FIG. 4C). The fixed portion 42 is oriented with its plate thickness direction in the front-rear direction, and extends upward from one end to the other. A latching projection 42A is formed on each plate width direction side (each connector width direction side) of the fixed portion 42. The latching projections 42A bite into the stationary housing 30, thereby fixing the fixed portion 42 to the press-fit portion 31B of the stationary housing 30 such that the stationary terminal 40 is retained in the stationary housing 30.

The spring section 43 is a portion of stationary terminal 40 that has been formed so as to more readily undergo elastic deformation. Specifically, in cases in which a downward load is applied to the stationary-side sliding portion 44 of the stationary terminal 40, the spring section 43 elastically deforms such that the stationary-side sliding portion 44 is displaced downward. In sequence from one end to the other, the spring section 43 includes a first bent portion 43A, a first straight portion 43B, a second bent portion 43C, and a second straight portion 43D.

The first bent portion 43A is bent toward a plate thickness direction front face side such that it has a profile that curves convexly upward. The direction of extension of the first bent portion 43A changes by at least 90° (approximately 110°) from one end to the other.

As illustrated in FIG. 2D, in a state in which the stationary terminal 40 is retained in the stationary housing 30 (and in a state not elastically deformed), the height direction position of the first bent portion 43A is above that of the limiting face portion 32 of the stationary housing 30. In this state, the front-rear direction position of the first bent portion 43A is also in front of the stationary-side contact portions 27 of the clips 20.

The first straight portion 43B is oriented with its plate thickness direction in substantially the up-down direction, and from one end to the other, extends in a straight line in an downward incline toward the rear.

The second bent portion 43C is bent toward a plate thickness direction rear face side such that it has a profile that curves convexly substantially rearward. The direction of extension of the second bent portion 43C changes by nearly 180° (approximately 170°) from one end to the other, such that the second bent portion 43C extends obliquely upward and to the front at its other end.

As illustrated in FIG. 2D, in a state in which the stationary terminal 40 is retained in the stationary housing 30 (and in a state not elastically deformed), the height direction position of the second bent portion 43C is substantially the same as, or below, that of the limiting face portion 32 of the stationary housing 30. In this state, the front-rear direction position of the second bent portion 43C is also behind the stationary-side contact portions 27 of the clips 20.

The second straight portion 43D is oriented such that its plate thickness direction is a direction angled with respect to the up-down direction and the front-rear direction, and extends from one end toward the other in a straight line in an upwardly inclined direction with respect to the forward direction (i.e. in a direction angled upward and toward the front).

As illustrated in FIG. 2D, in a state in which the stationary terminal 40 is retained in the stationary housing 30 (and in a state not elastically deformed), the second straight portion 43D is positioned above the limiting face portion 32 of the stationary housing 30.

The stationary-side sliding portion 44 is a portion that makes sliding contact with part of the movable terminal 70 (a movable-side sliding portion 71). The stationary-side sliding portion 44 is bent toward the plate thickness direction rear face side such that it has a profile that curves convexly upward. The front face (smooth face) of the stationary-side sliding portion 44, this being the face at the upper side of the stationary-side sliding portion 44, thereby curves convexly upward. The convexly curved portion of the smooth face of the stationary-side sliding portion 44 makes contact with the movable-side sliding portion 71 of the movable terminal 70 from the lower side.

As illustrated in FIG. 2D, in a state in which the stationary terminal 40 is retained in the stationary housing 30 (and in a state not elastically deformed), the stationary-side sliding portion 44 is positioned above the limiting face portion 32 of the stationary housing 30 and above the upper wall portions 23 of the clips 20.

In the assembled state, upward load (elastic force) from the stationary-side sliding portion 44 acts on the movable-side sliding portion 71. Namely, while the fixed portion 42 of the stationary terminal 40 is fixed to the press-fit portion 31B of the stationary housing 30, the stationary-side sliding portion 44 of the stationary terminal 40 bears downward load from (the movable terminal 70 of) the movable-side member 14. The spring section 43 of the stationary terminal 40 is elastically deformed thereby. Elastic force from the stationary terminal 40 (and elastic force from the clips 20) presses the movable-side member 14 upward such that the limited portions 52 of the movable shield 50 adopt a state pressed against the upper wall portions 23 (upper limiting portions) of the clips 20 (see FIG. 1B and FIG. 1D)

Movable Terminal 70

Figure 8A:
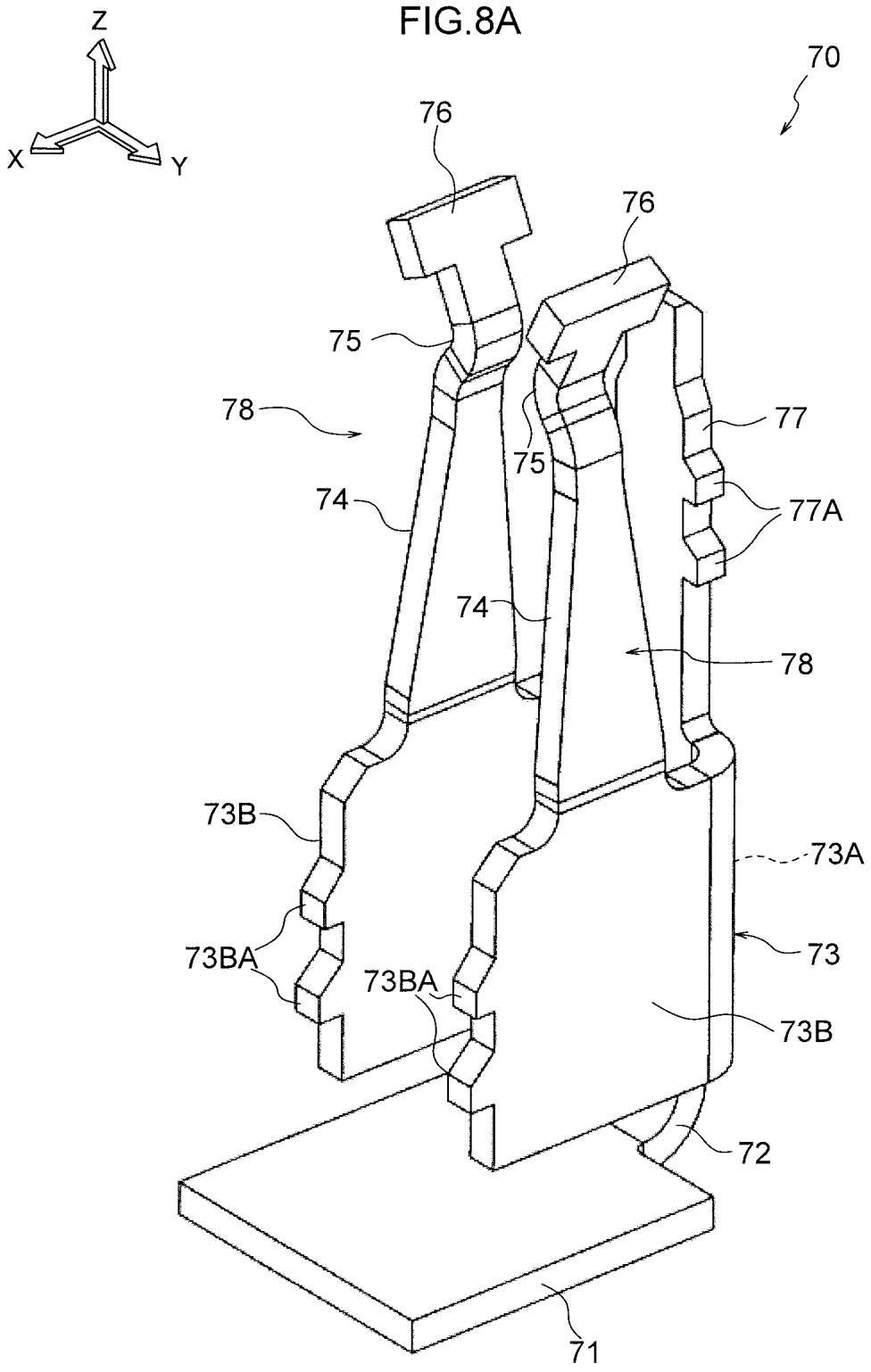
FIG. 8A is a perspective view of a movable terminal.
Figure 8B:
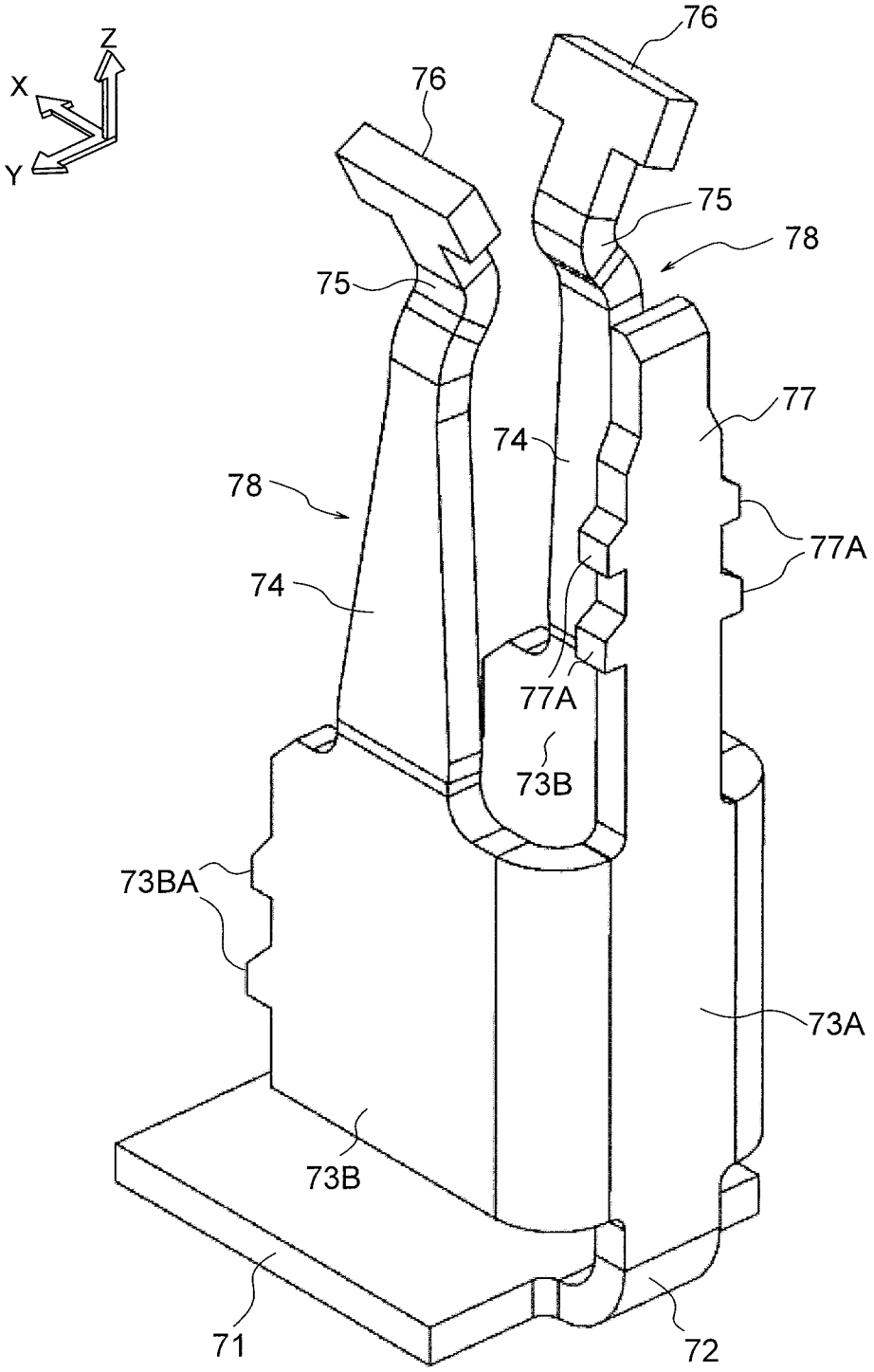
FIG. 8B is a perspective view of a movable terminal as seen from another angle.
Figure 8C:
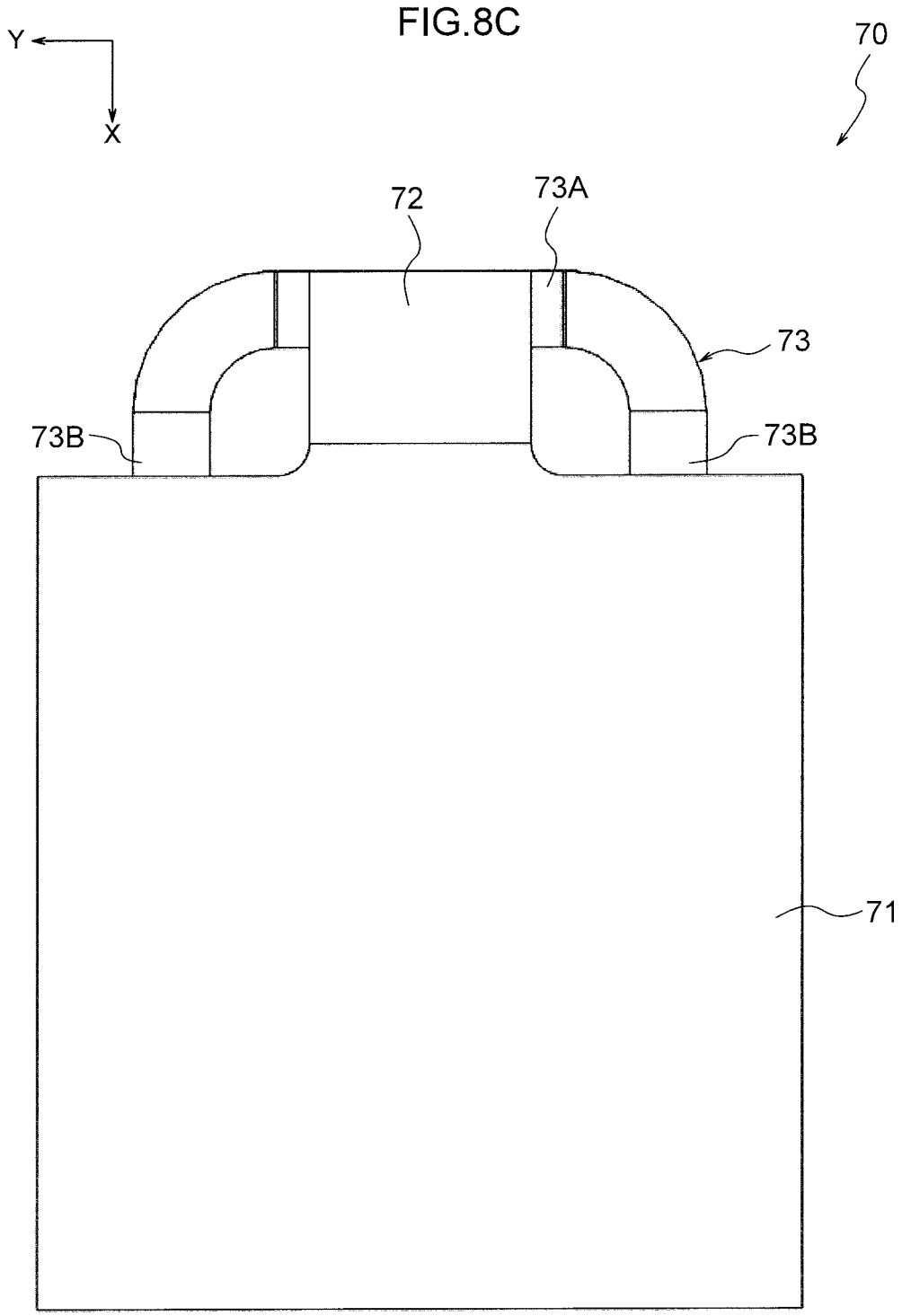
FIG. 8C is a bottom face view of a movable terminal.

FIG. 8A to FIG. 8C illustrate a movable terminal 70. The movable terminal 70 is a signal terminal. A metal sheet blank is punched, and then bent, to form the movable terminal 70. Accordingly, the front face and the rear face (the faces on each side in the plate thickness direction) of the movable terminal 70 are configured by smoother faces than faces that are formed by punching (faces connecting the front face and the rear face to one another, punch-sheared faces). In the present specification, the front face and the rear face of the movable terminal 70 are referred to as smooth faces. Note that of the smooth faces of the movable terminal 70, the smooth face on the side that makes contact with a connection target 80 is the front face, and the smooth face on the opposite side is the rear face.

The movable terminal 70, this being a main configuration element, includes the movable-side sliding portion 71, a U-shaped portion 73, a first fixed portion 77, and contact portions 75.

The movable-side sliding portion 71 is a portion that makes sliding contact with the stationary-side sliding portion 44 of the stationary terminal 40. The movable-side sliding portion 71 has a flat plate shape that is oriented with its plate thickness direction in the up-down direction, and the movable-side sliding portion 71 is rectangular shaped in plan view. The smooth face on the lower side of the movable-side sliding portion 71 makes contact with the smooth face on the upper side of the stationary-side sliding portion 44.

The U-shaped portion 73 is a portion with a substantially U-shaped cross-section profile (a cross-section profile orthogonal to the connector up-down direction). Namely, the U-shaped portion 73 is configured by a bottom plate portion 73A that is oriented with its plate thickness direction in the front-rear direction, and a pair of side plate portions 73B that extend forward from width direction ends of the bottom plate portion 73A. The pair of side plate portions 73B are both oriented with their plate thickness directions in the connector width direction, run parallel to each other, and face each other.

Latching projections 73BA are formed at the leading end side (front end side) of each of the pair of side plate portions 73B. The latching projections 73BA bite into an inner face of the movable housing 60, thereby press fitting the pair of side plate portions 73B of the movable terminal 70 into the movable housing 60 so as to be fixed thereto. Namely, the pair of side plate portions 73B function as second fixed portions that are fixed to the movable housing 60.

The movable-side sliding portion 71 and the U-shaped portion 73 are coupled together by a bent coupling portion 72. The coupling portion 72 couples a width direction central portion of a rear end of the movable-side sliding portion 71 to a width direction central portion of a lower end of the bottom plate portion 73A of the U-shaped portion 73.

The first fixed portion 77 is formed extending upward from a width direction central portion of an upper end of the bottom plate portion 73A of the U-shaped portion 73. Latching projections 77A are formed at each plate width direction side (each connector width direction side) of the first fixed portion 77. The latching projections 77A bite into an inner face of the movable housing 60, thereby press fitting the first fixed portion 77 of the movable terminal 70 into the movable housing 60 so as to be fixed thereto.

The movable terminal 70 includes a pair of spring tabs 78. The pair of spring tabs 78 extend upward from the upper end of the pair of side plate portions 73B of the U-shaped portion 73. The spring tabs 78 each include an arm portion 74, a contact portion 75, and a guide portion 76 in this sequence on progression toward a leading end side of the spring tab 78.

The pair of arm portions 74 are inclined toward the connector width direction inside such that a gap therebetween gradually narrows on progression upward. Each of the arm portions 74 extends in a straight line. The plate width (the dimension along the connector front-rear direction) of each arm portion 74 gradually narrows on progression upward.

The pair of contact portions 75 are curved so as to protrude toward one another. The pair of contact portions 75 make contact with both connector width direction sides of a terminal portion 82 of the connection target 80 (see FIG. 11) that is inserted downward from above. The plate width of each contact portion 75 is the same as the plate width of the upper ends of the arm portions 74.

The pair of guide portions 76 are portions with a plate width (the dimension in the connector front-rear direction) that is comparatively larger than the plate width of the contact portions 75. The variation in plate width from the contact portions 75 to the guide portions 76 is not a gradual increase, rather it is a sudden increase at the border between the contact portions 75 and the guide portions 76. Namely, the leading end portions of the arm portions 74 are T-shaped.

The movable-side sliding portion 71 has a rectangular shape with each of its sides oriented along either the connector width direction or the connector front-rear direction. The connector width direction (left-right direction)

dimension of the movable-side sliding portion 71 is larger than the left-right direction dimension of the U-shaped portion 73. Accordingly, as illustrated in FIG. 8C, the majority of the pair of side plate portions 73B of the U-shaped portion 73 is hidden by the movable-side sliding portion 71 in bottom face view. The base portions of the pair of side plate portions 73B (boundary portions between the bottom plate portion 73A and the side plate portions 73B) are not hidden by the movable-side sliding portion 71 in bottom face view. The movable terminal 70 is press fit into the movable housing 60 by pushing these visible portions of the movable terminal 70 upward from the underneath.

Movable Housing 60

Figure 9A:
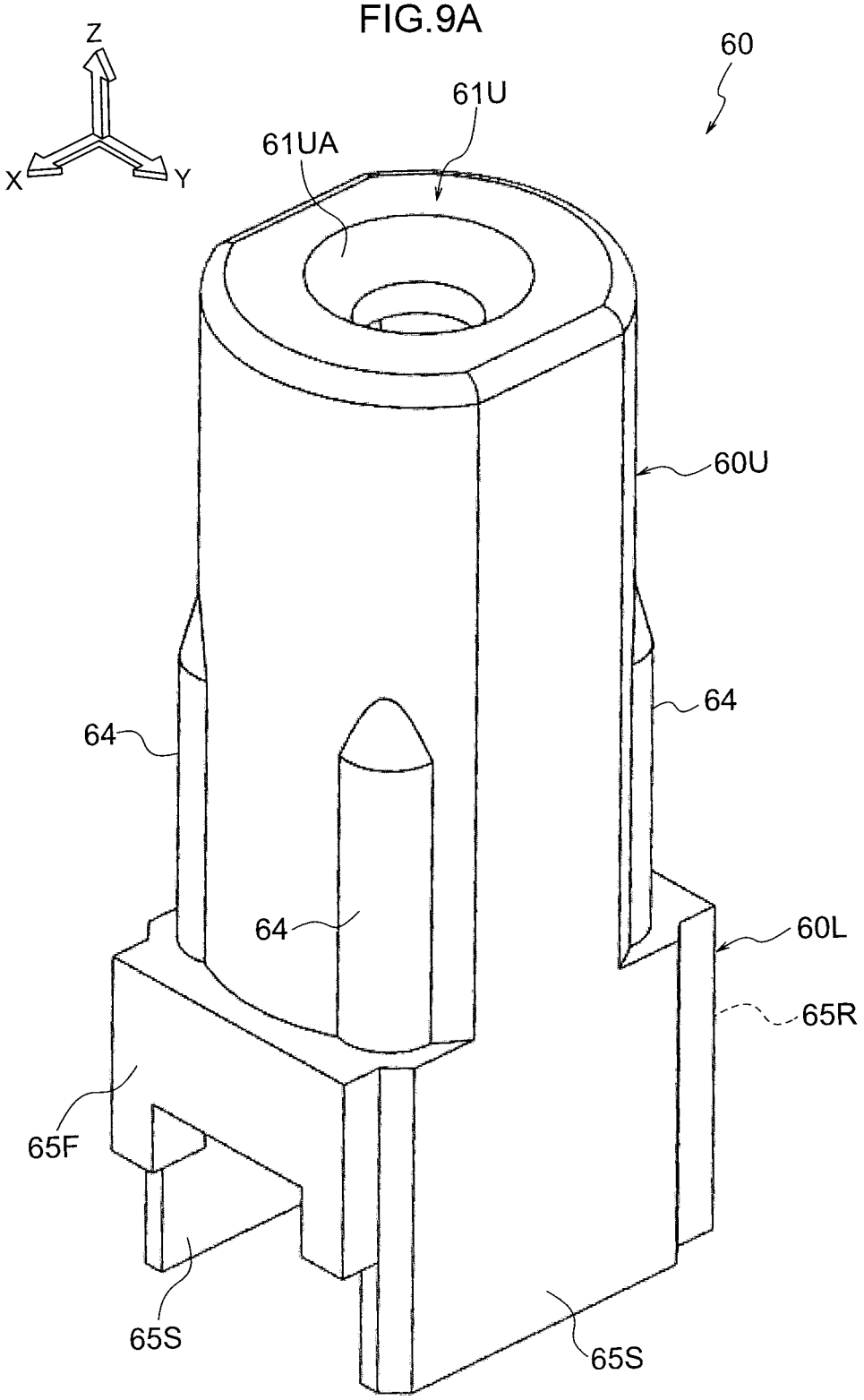
FIG. 9A is a perspective view of a movable housing.
Figure 9B:
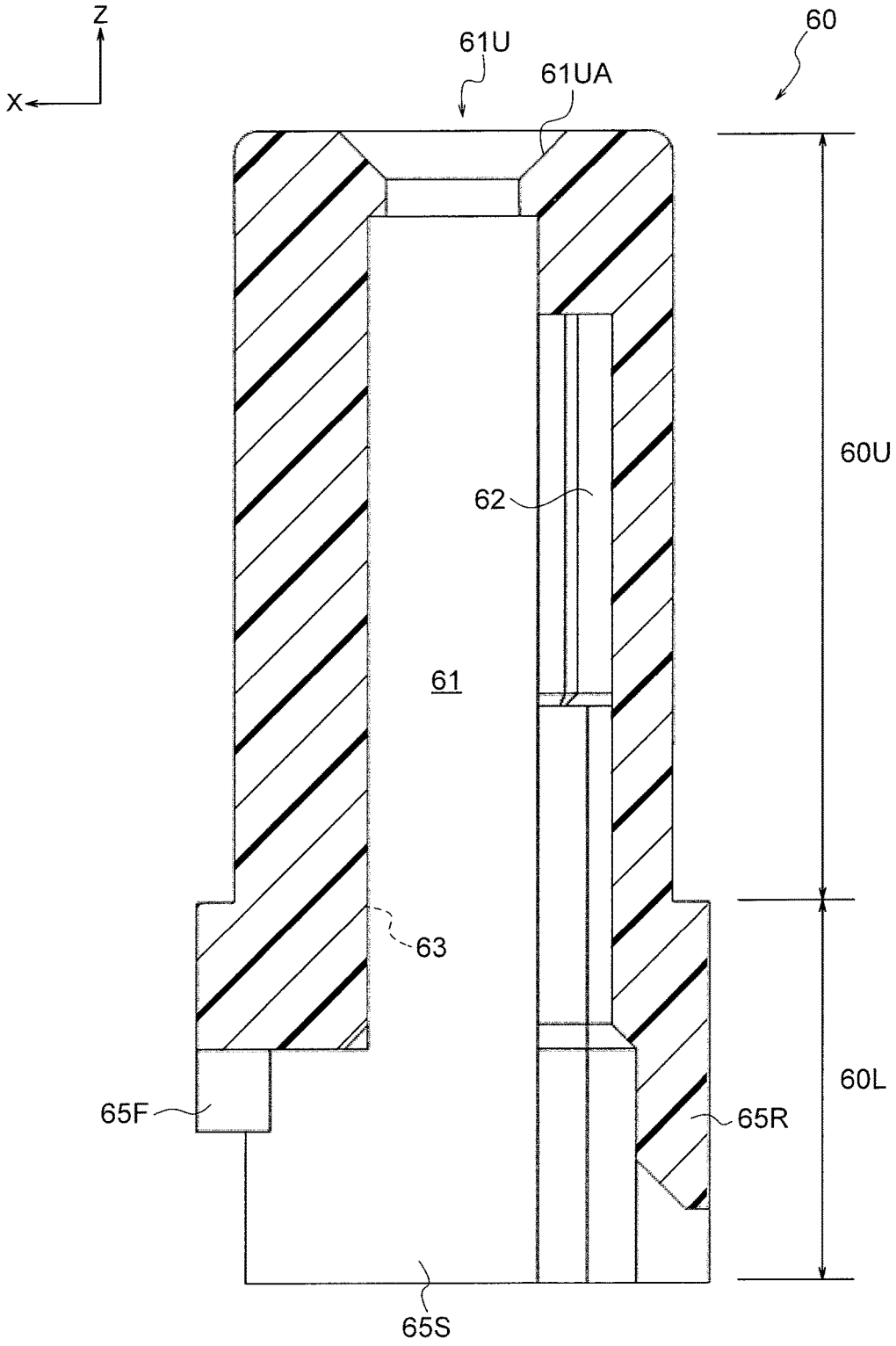
FIG. 9B is a side view cross-section of a movable housing.

FIG. 9A and FIG. 9B illustrate the movable housing 60. The movable housing 60 is configured from an insulator such as a synthetic resin.

The movable housing 60 includes a retaining portion 61 that retains the movable terminal 70 (see FIG. 9B). Specifically, the movable housing 60 is tube-shaped with its axial direction in the up-down direction, and the movable housing 60 retains the movable terminal 70 in the internally provided retaining portion 61 (see FIG. 1E).

As illustrated in FIG. 9B, the movable housing 60 includes a first fixing portion 62 into which the first fixed portion 77 of the movable terminal 70 is press fitted, and a second fixing portion 63 into which the pair of side plate portions 73B (second fixed portions) of the U-shaped portion 73 of the movable terminal 70 are press fitted. The first fixing portion 62 and the second fixing portion 63 are formed at the inside of the retaining portion 61.

An opposing-terminal insertion hole 61U is formed passing through an upper end of the retaining portion 61 in the up-down direction. The opposing-terminal insertion hole 61U has a circular shape. A tapered portion 61UA that leads the terminal portion 82 of the connection target 80 (see FIG. 11) into the retaining portion 61 is formed at an upper portion of the opposing-terminal insertion hole 61U.

As illustrated in FIG. 9A, looking at sections of the outer profile of the movable housing 60, the movable housing 60 is configured from an upper section 60U that has a substantially circular column shaped outer profile and a lower section 60L that has a substantially rectangular shaped outer profile. Specifically, the outer profile of the upper section 60U of the movable housing 60 is configured with arcuate face shaped front and rear portions and with flat face shaped left and right portions. The upper section 60U of the movable housing 60 thus has a profile with a front-rear direction orientation, enabling the movable housing 60 to be positioned in a direction about an axis of rotation with respect to the movable shield 50.

Plural (four, in the present exemplary embodiment) protrusions 64 are formed protruding outward from the outer circumferential face of the movable housing 60. The protrusions 64 are formed to a lower side portion of the upper section 60U of the movable housing 60 and extend in the up-down direction. Press-contacting the protrusions 64 against the inner face of the movable shield 50 results in a state in which the movable housing 60 and the movable shield 50 are combined into a single unit and do not readily separate from each other.

Figure 3B:
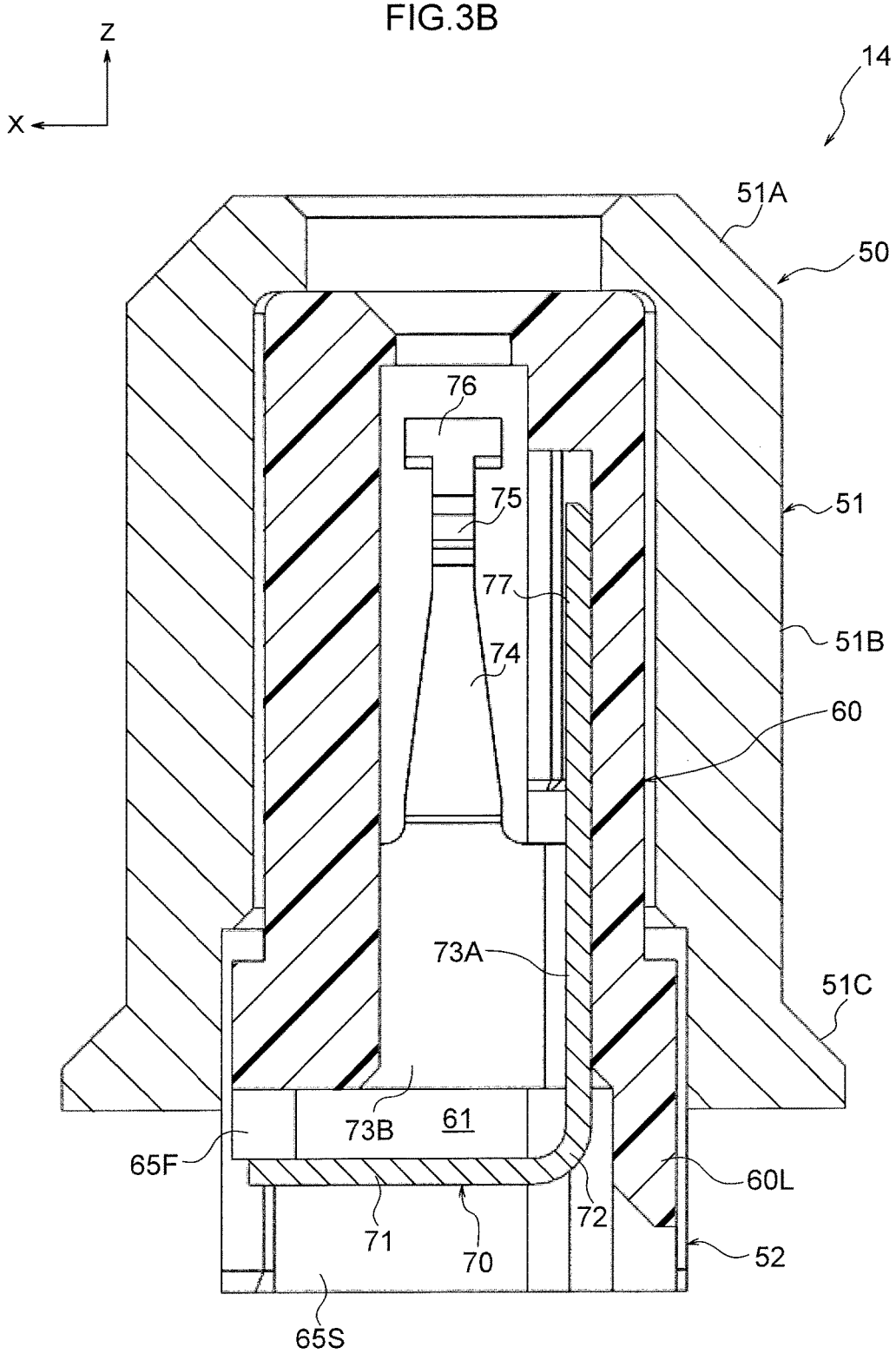
FIG. 3B is a side view cross-section of a movable-side member.

As illustrated in FIG. 9A, the lower section 60L of the movable housing 60 includes a front wall 65F, left and right side walls 65S, and a rear wall 65R. As illustrated in FIG. 3B, the movable-side sliding portion 71 of the movable terminal 70 is disposed within the retaining portion 61 in the lower section 60L of the movable housing 60. The two width direction ends of the movable-side sliding portion 71 make contact with the left and right side walls 65S of the lower section 60L of the movable housing 60.

The position of a lower end of the front wall 65F of the lower section 60L of the movable housing 60 is formed higher than that of the left and right side walls 65S. A front end portion of the movable-side sliding portion 71 (an end portion on the opposite side to that where the coupling portion 72 extends) makes contact with the lower end of the front wall 65F from the lower side (see FIG. 3B). Specifically, the position of the lower end of the front wall 65F is formed high toward a width direction center of the front wall 65F, and is formed lower toward the two width direction outsides of the front wall 65F. The lower ends of width direction outside portions of the front wall 65F make contact with the front end portion of the movable-side sliding portion 71 from the lower side.

Movable Shield

Figure 10A:
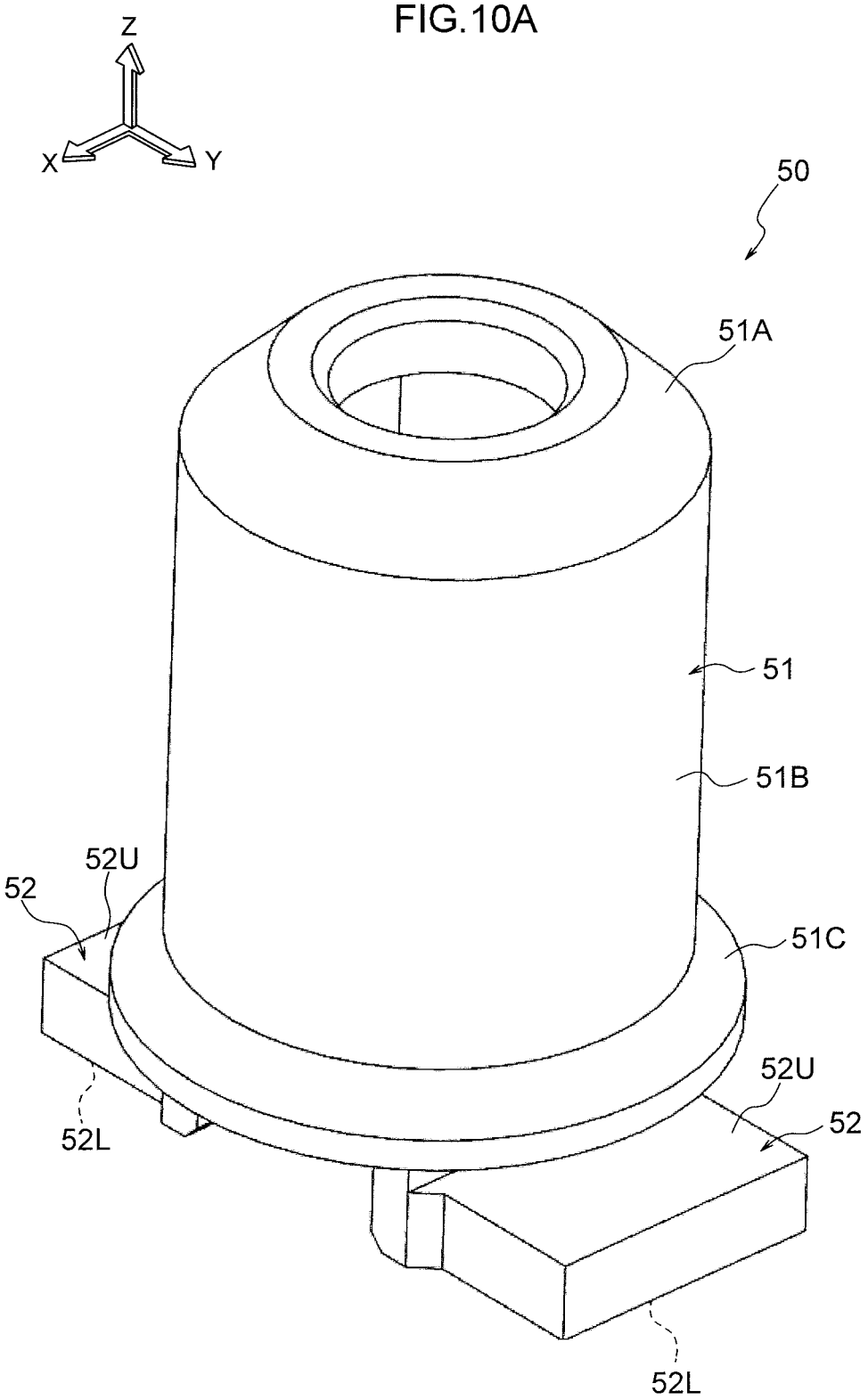
FIG. 10A is a perspective view of a movable shield.
Figure 10B:
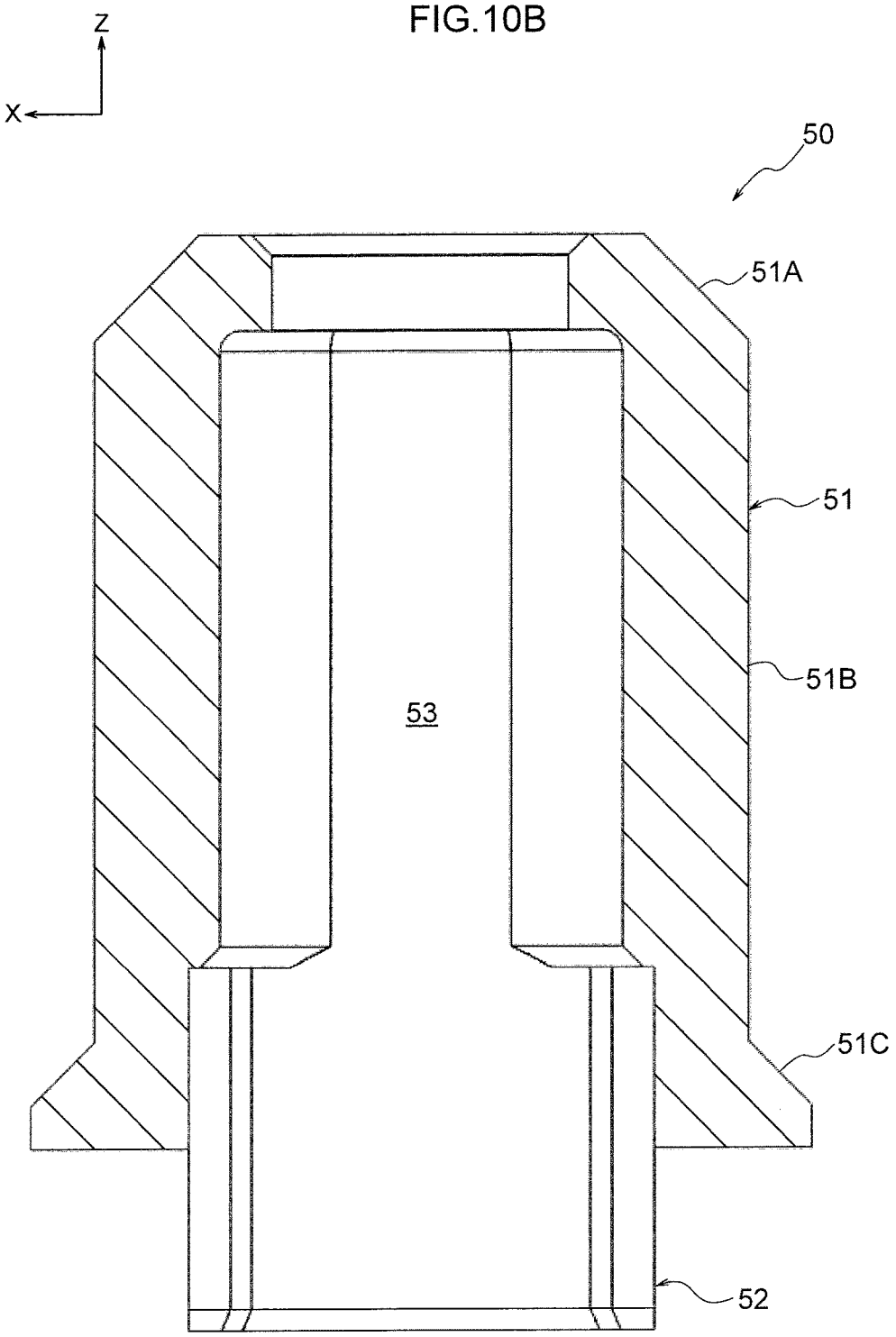
FIG. 10B is a side view cross-section of a movable shield.

FIG. 10A to FIG. 10B illustrate the movable shield 50. The movable shield 50 is configured from a good conductor such as metal, and is die cast.

The movable shield 50 includes a tube-shaped tubular portion 51 that circumferentially surrounds the movable housing 60, and limited portions 52 located below the tubular portion 51.

The tubular portion 51 surrounds the movable terminal 70 from the connector front-rear and left-right directions, thereby functioning to shield the movable terminal 70. The movable shield 50 forms a unit with the movable housing 60 such that the movable housing 60 is covered by the tubular portion 51 (see FIG. 3B).

The limited portions 52 are portions that are restricted to the inside of the gap 92 (see FIG. 2C). By restricting the limited portions 52 to the inside of the gap 92, the range of movement of the movable-side member 14 is limited to a given range of motion with respect to the stationary-side member 12.

Figure 1E:
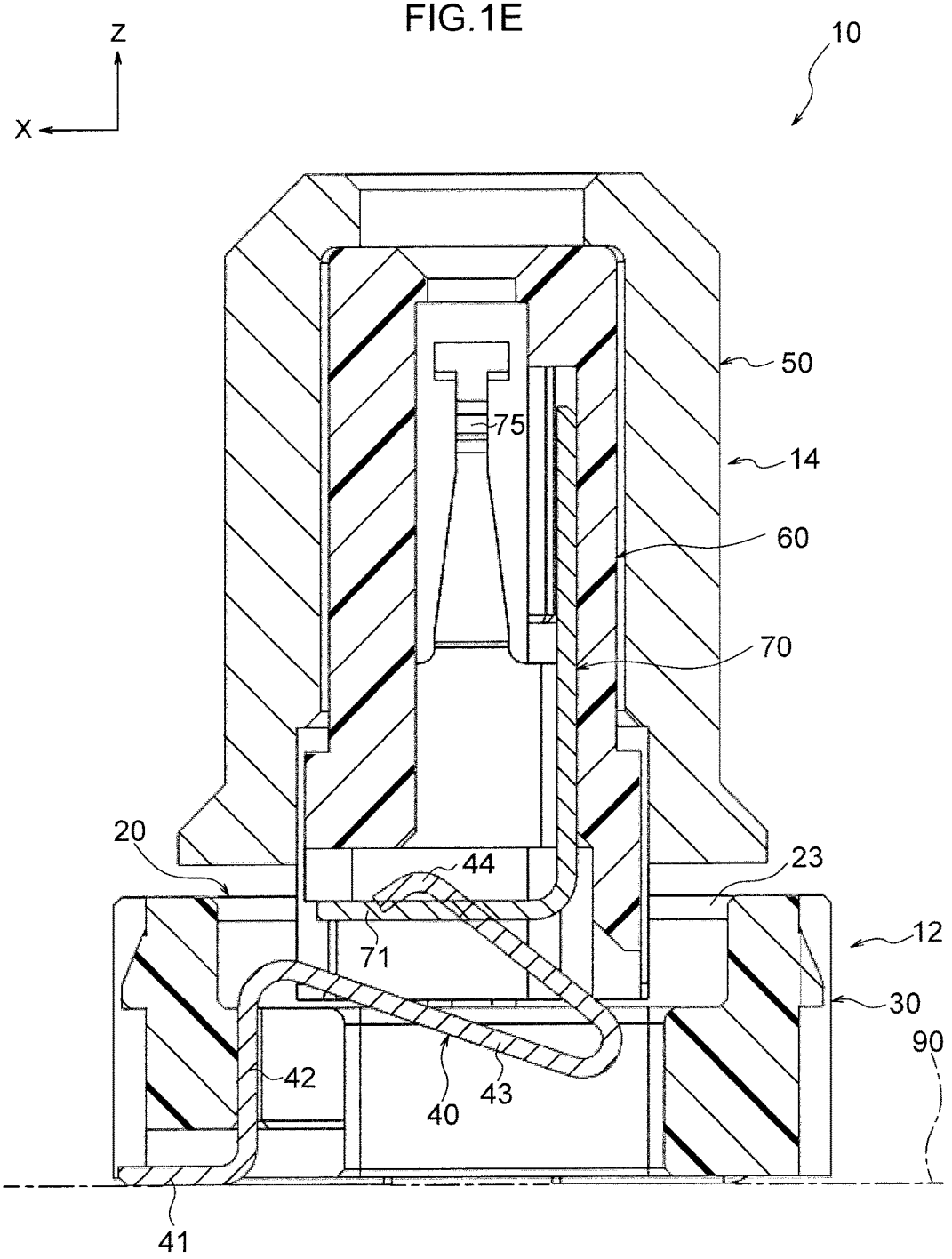
FIG. 1E is a cross-section of an assembled connector taken along a plane orthogonal to a connector width direction.
Figure 1F:
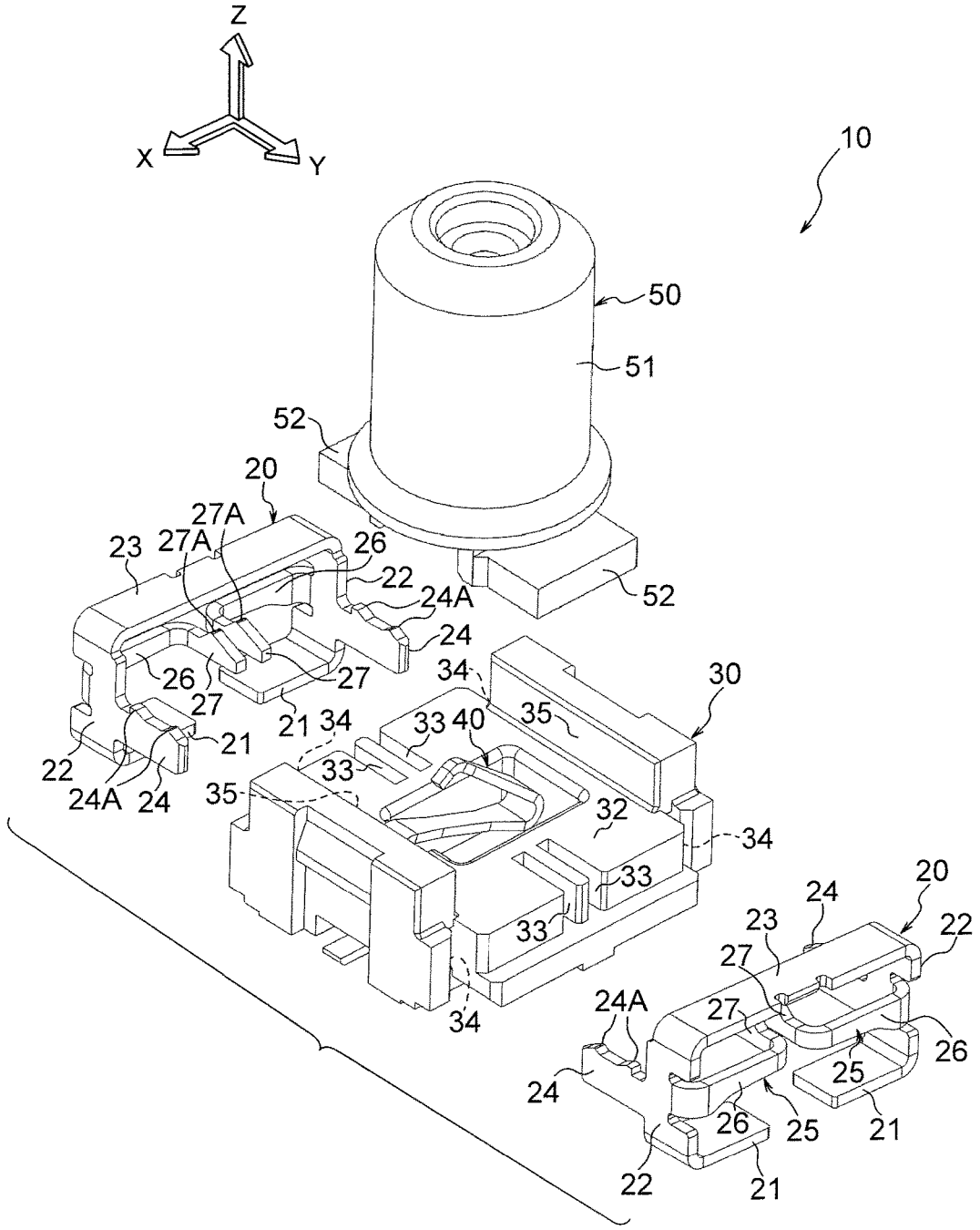
FIG. 1F is an exploded perspective view of a connector.

The tubular portion 51 has a circular tube shape, and as illustrated in FIG. 1E and FIG. 10B, includes an internal retaining portion 53 in which the movable housing 60 is retained. The retaining portion 53 is configured by a space that extends in the up-down direction. An upper end of the retaining portion 53 is open so as to receive the terminal portion 82 of the connection target 80, and a lower end of the retaining portion 53 is open so as to receive the movable housing 60.

The interior profile of the tubular portion 51 is shaped so as to fit together with the exterior profile of the movable housing 60. In a state in which the front-rear direction of the movable shield 50 and the front-rear direction of the movable housing 60 have been aligned, the movable shield 50 and the movable housing 60 can be combined into a single unit.

The exterior profile of the tubular portion 51 has a circular shape in plan view. In detail, an upper portion (tapered portion 51A) of the tubular portion 51 has a diameter that gradually decreases on progression upward, an up-down direction intermediate portion (vertical portion 51B) of the tubular portion 51 has a constant diameter and extends along the up-down direction, and a lower portion (skirt portion 51C) of the tubular portion 51 has a diameter that gradually increases on progression downward. The tapered portion 51A at the upper portion of the tubular portion 51 is capable of guiding shield connection portions 84 (see FIG. 11) of the connection target 80 toward the vertical portion 51B at the up-down direction intermediate portion of the tubular portion 51 as appropriate (see FIG. 12).

The limited portions 52 are formed below the tubular portion 51. The limited portions 52 are formed at the left and right of the tubular portion 51 and project toward the left-right direction outsides. The limited portions 52 are disposed in the gap 92 above the limiting face portion 32 of the stationary housing 30 and below the upper wall portions 23 of the clips 20.

When the movable-side member 14 moves downward, lower faces 52L of the limited portions 52 abut the limiting face portion 32 of the stationary housing 30. When the movable-side member 14 moves upward, upper faces 52U of the limited portions 52 abut the upper wall portions 23 of the clips 20. The range of up-down direction movement of the movable-side member 14 with respect to the stationary-side member 12 is thereby limited.

The limited portions 52 are formed in cuboidal shapes. The lower faces 52L of the limited portions 52 are configured as planar surfaces that have normals pointing in a downward direction, and the upper faces 52U of the limited portions 52 are configured as planar surfaces that have normals pointing in upward directions.

Over a given range of motion (a range of motion limited by interference between the movable shield 50 and the stationary housing 30, and by interference between the movable shield 50 and the clips 20), the movable-side member 14 is capable of moving along the front-rear direction, the left-right direction, and the up-down direction with respect to the stationary-side member 12, and in this given range of motion, the movable-side member 14 is capable of rotating about its up-down direction axis and capable of tilting its up-down direction axis.

The lower faces 52L of the limited portions 52 make contact with the stationary-side contact portions 27 of the clips 20 (see FIG. 1D). The elastic spring sections 25 of the clips 20 are accordingly elastically deformed downward. The stationary-side contact portions 27 thus press the limited portions 52 upward due to elastic force from the elastic spring sections 25. When the connector 10 is in an assembled state, the upper faces 52U of the limited portions 52 thereby adopt a state in contact with the upper wall portions 23 of the clips 20.

Connection to Connection Target

Figure 11:
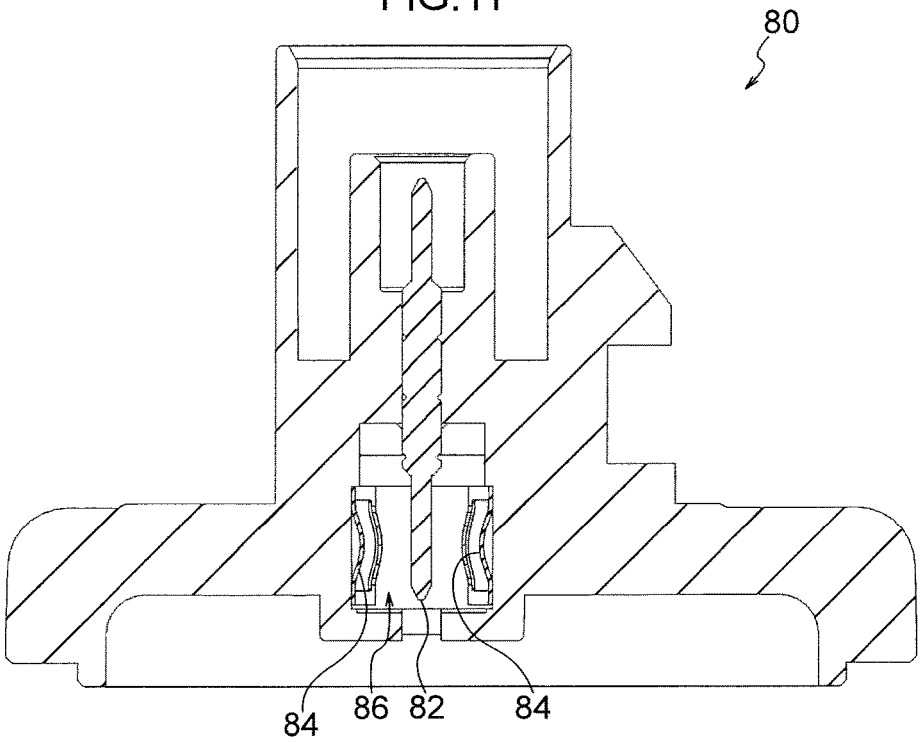
FIG. 11 is a cross-section of a connection target.
Figure 12:
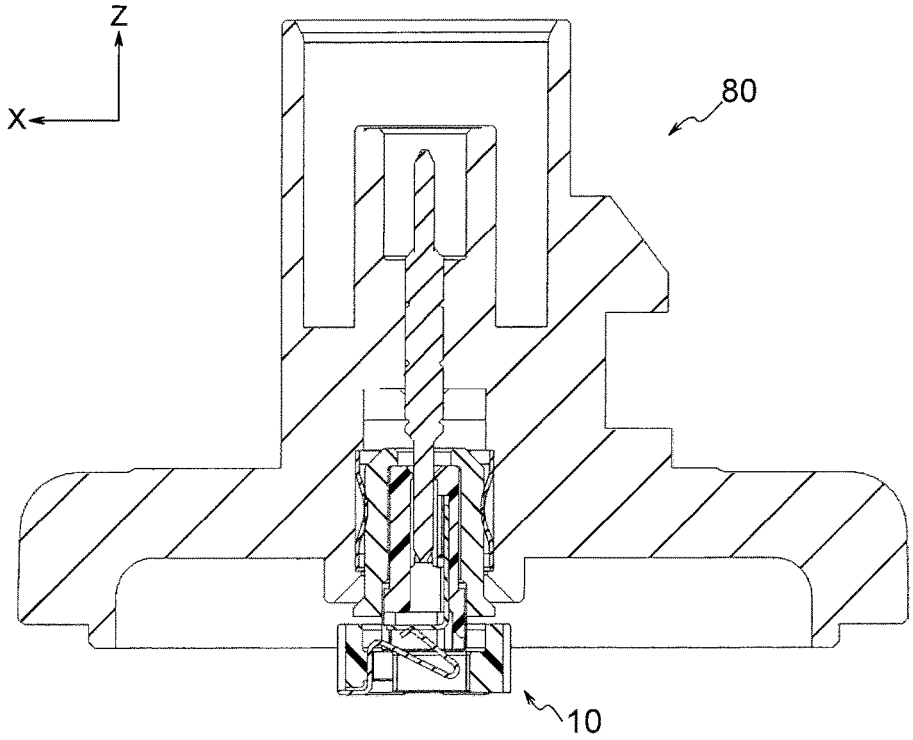
FIG. 12 is a cross-section of a connection structure in which a connector and a connection target have been connected.

FIG. 11 illustrates the connection target 80, and FIG. 12 illustrates a connection structure in which the connector 10 and the connection target 80 have been connected.

As illustrated in FIG. 11, the connection target 80 includes an insertion portion 86, which is a substantially circular tube-shaped space into which the movable shield 50 of the connector 10 is inserted. The connection target 80 also includes a terminal portion 82, of which a leading end is disposed in the insertion portion 86, and shield connection portions 84 that are disposed at side faces within the insertion portion 86.

As illustrated in FIG. 12, the connector 10 is connected to the connection target 80 by inserting the movable shield 50 of the connector 10 into the insertion portion 86 of the connection target 80. In a connected state, the pair of contact portions 75 of the connector 10 make contact with the terminal portion 82 of the connection target 80 from the connector horizontal direction, and the shield connection portions 84 of the connection target 80 make contact with the vertical portion 51B of the tubular portion 51 of the movable shield 50 of the connector 10 from the connector horizontal direction.

OPERATION AND ADVANTAGEOUS EFFECTS

Explanation follows regarding the operation and advantageous effects of the present exemplary embodiment.

In the present exemplary embodiment, the connector 10 includes the stationary housing 30 and the movable housing 60. The stationary housing 30 is fixed to the substrate 90, and the movable housing 60 is capable of moving with respect to the stationary housing 30 along the front-rear direction and the left-right direction, which are mutually orthogonal and run parallel to a planar surface of the substrate 90.

The stationary terminal 40, including the substrate connection portion 41 that is connected to the substrate 90, is retained in the stationary housing 30, and the movable terminal 70 including the contact portions 75 that makes contact with the terminal portion 82 of the connection target 80 are retained in the movable housing 60. The contact portions 75 are accordingly configured to follow the movement of the movable housing 60. The substrate connection portion 41 and the contact portions 75 are also electrically connected.

Even if the position (of the terminal portion 82) of the connection target 80 with respect to the substrate 90 is offset in a direction parallel to the planar surface of the substrate 90, this positional offset is able to be absorbed by the movable housing 60 moving with respect to the stationary housing 30 and by the contact portions 75 also moving so as to follow the movable housing 60.

Further, in the present exemplary embodiment, the connector 10 includes the movable shield 50 that makes contact with the shield connection portions 84 of the connection target 80, and the clips 20 that are formed separately to the movable shield 50 and that make contact with the movable shield 50 so as to have electrical continuity therewith. When the movable housing 60 moves in a direction parallel to the planar surface of the substrate 90 with respect to the stationary housing 30, the clips 20 and the movable shield 50 are configured to slide against one another while maintaining electrical continuity.

Thus, even if the position (of the shield connection portions 84) of the connection target 80 with respect to the substrate 90 is offset in a direction parallel to the planar surface of the substrate 90, this positional offset is able to be absorbed by the movable housing 60 moving with respect to the stationary housing 30 and by the movable shield 50 moving so as to follow the movable housing 60. Moreover, since positional offset is absorbed by the sliding of the clips 20 and the movable shield 50, situations in which stress is concentrated on the shield members (the clips 20 and the movable shield 50), causing damage, are suppressed.

This combats the ingress and emission of electromagnetic noise, and enables the likelihood of damage to the connector 10 caused by concentrated stress to be reduced.

Further, in the present exemplary embodiment, the ingress and emission of electromagnetic noise is able to be efficiently prevented due to the tube-shaped tubular portion 51 of movable shield 50 surrounding the movable terminal 70 from the front-rear and left-right directions.

In the present exemplary embodiment, the ingress and emission of electromagnetic noise is able to be efficiently prevented.

Namely, to surround the movable terminal 70, for example, a movable shield may be configured from a punched, thin metal sheet, and this thin metal sheet made to cover the outer periphery of the movable housing. However, it is difficult to join together both end portions of the metal sheet in such a movable shield without any gaps therebetween, and so gaps may be formed at this joint. Further, even in cases in which a recess is formed in one end portion of a metal sheet and a protrusion is formed in the other end portion of the metal sheet and these two ends are joined together, slight gaps may still be present at this joint.

However, in the present exemplary embodiment, the movable shield 50 is die cast and is structured such that there are no circumferential joints in the tubular portion 51 of the movable shield 50. This movable terminal 70 is thus able to be gaplessly surrounded. This enables the ingress and emission of electromagnetic noise to be efficiently prevented.

Further, the present exemplary embodiment enables the loss (interruption) of electrical continuity between the clips 20 and the movable shield 50 to be suppressed.

Namely, when the movable housing 60 has moved with respect to the stationary housing 30, in particular when the movable housing 60 has received vibrations or a shock, there is a risk that the clips 20 and the movable shield 50 will lose contact with each other and that noise will be emitted from the movable shield 50 and the clips 20.

However, in the present exemplary embodiment, within the range of movement of the movable housing 60, the clips 20 are in an elastically deformed state at all times, and this elastic force acts in directions causing the clips 20 and the movable shield 50 be in pressing contact so as to have electrical continuity.

This enables the loss (interruption) of electrical continuity between the clips 20 and the movable shield 50 to be suppressed after the receipt of vibration or shock, enabling the connector 10 to be well-equipped to handle noise.

Further, the present exemplary embodiment enables the likelihood of damage to the elastic spring sections 25 of the clips 20 to be reduced.

Namely, were the elastic spring sections 25 to be used to abut the limited portions 52 of the movable shield 50 from the lower side and limit downward movement of the movable housing 60 during downward movement of the movable housing 60, the elastic spring sections 25 would be at risk of plastically deforming and snapping due to being unable to cope with the pressing force received.

However, in the present exemplary embodiment, the upper wall portions 23 (upper limiting portions) of the clips 20 limit movement when the movable housing 60 moves upward, and the limiting face portion 32 of the stationary housing 30 limits movement when the movable housing 60 moves downward. This prevents excessive load from acting on the clips 20. Thus, damage to the elastic spring sections 25 of the clips 20 is able to be suppressed.

Further, even while the limiting face portion 32 abuts the limited portions 52, the stationary-side contact portions 27 of the elastic spring sections 25 maintain elastic contact with the lower side of the limited portions 52 through the openings in the recesses 33 despite being fit inside the recesses 33. This enables the electrical continuity between the clips 20 and the movable shield 50 to be stably maintained.

Further, in the present exemplary embodiment, the connector 10 includes the stationary housing 30 that is fixed to the substrate 90, and the movable housing 60 that is capable of moving in the front-rear direction and the left-right direction with respect to the stationary housing 30. The stationary terminal 40 is retained in the stationary housing 30, and the movable terminal 70 is retained in the movable housing 60. The stationary terminal 40 and the movable terminal 70 are in mutual contact so as to have electrical continuity, and the movable terminal 70 includes the contact portions 75 that have electrical continuity with the terminal portion 82 of the connection target 80.

When the movable housing 60 moves in the front-rear or left-right direction with respect to the stationary housing 30, the stationary terminal 40 and movable terminal 70 slide against one another while maintaining electrical continuity. Namely, when the movable housing 60 moves in either of two directions (the front-rear direction or the left-right direction) parallel to the planar surface of the substrate 90 with respect to the stationary housing 30, the stationary terminal 40 and the movable terminal 70 slide against one another while maintaining electrical continuity.

Specifically, the position of contact between the stationary terminal 40 and the movable terminal 70 moves (slides) over the smooth face at the lower side of the movable-side sliding portion 71 of the movable terminal 70 in the front-rear or left-right direction.

Accordingly, stress is less liable to concentrate on the terminal, enabling damage to the terminal to be suppressed compared to a conventional connector in which all positional offset is absorbed by elastic deformation of an elastic portion when positional offset arises in either of two directions parallel to the planar surface of a substrate.

Moreover, since the smooth faces of the stationary terminal 40 and the movable terminal 70 are in contact with each other, wear due to the stationary terminal 40 and the movable terminal 70 sliding against one another is less liable to arise, and stable electrical continuity is achieved between the stationary terminal 40 and the movable terminal 70, as compared to cases in which plate thickness faces (punch-sheared faces) of the two are in contact with one another or cases in which a plate thickness face of one is in contact with a smooth face of the other.

Further, the contact portions 75 of the movable terminal 70 that have electrical continuity with the terminal portion 82 of the connection target 80 are in contact with the connection target 80 along a direction parallel to the planar surface of the substrate 90 (namely, along a direction orthogonal to the insertion direction of the connection target 80).

The contact portions 75 thus make contact with the connection target from underneath, this being a direction perpendicular to the substrate 90, enabling the load borne by the substrate 90 accompanying connection of the connection target 80 to be reduced compared to a conventional connector that receives downward (a direction perpendicular to the substrate) counterforce from a connection target to ensure contact pressure. This enables the connector 10 to be made less liable to warp the substrate 90 after being connected to the connection target 80.

Further, in the present exemplary embodiment, the connector 10 includes the upper limiting portion (the upper wall portions 23 of the clips 20) that limit the range of upward movement (namely, in the direction the connection target is removed) of the movable housing 60 with respect to the stationary housing 30. The upper limiting portion keeps the stationary terminal 40 in an elastically deformed state at all times, and elastic force due to this elastic deformation acts along a direction keeping the stationary terminal 40 and the movable terminal 70 in pressing contact so as to have electrical continuity. This stabilizes the electrical continuity between the stationary terminal 40 and the movable terminal 70.

Further, since the upper limiting portion (the upper wall portions 23 of the clips 20) is combined with the stationary housing 30 into a single unit, load received by the upper limiting portion due to limiting the range of upward movement of the movable housing 60 is transmitted to the stationary housing 30.

As this load is upward load, downward load received by the stationary housing 30 from the movable terminal 70 through the stationary terminal 40 is cancelled out. As a result, the load transmitted toward the substrate 90 from the connector 10 is reduced.

Thus, in the present exemplary embodiment, electrical continuity between the stationary terminal 40 and the movable terminal 70 is stabilized, and warping of the substrate 90 is able to be prevented.

Further, in the present exemplary embodiment, the upper limiting portion that limits the range of upward movement of the movable housing 60 with respect to the stationary housing 30 is formed as an integral part of the clips 20 for fixing the stationary housing 30 to the substrate 90. Thus, a mounting operation is simplified compared to configurations in which the upper limiting portion is formed separately to a member for fixing a stationary housing to a substrate.

Further, in the present exemplary embodiment, as for example illustrated in FIG. 8A, the movable-side sliding portion 71, this being the portion of the movable terminal 70 that makes contact with the stationary terminal 40, has its plate thickness direction in the up-down direction, and the U-shaped portion 73 is positioned above the movable-side sliding portion 71. The U-shaped portion 73 includes the bottom plate portion 73A and the pair of side plate portions 73B, and the bottom plate portion 73A is connected to the movable-side sliding portion 71. The contact portions 75 that make contact with the terminal portion 82 of the connection target 80 are formed in a pair at ends extending upward from the pair of side plate portions 73B so as to pinch the terminal portion 82 of the connection target 80 and make contact therewith. The left-right direction dimension (the connector width direction, the direction in which the pair of side plate portions 73B face one another) of the movable-side sliding portion 71 is greater than that of the U-shaped portion 73, enabling a large amount of left-right direction positional offset of the connection target 80 to be absorbed.

Further, in the present exemplary embodiment, as for example illustrated in FIG. 8A, the first fixed portion 77 press fitted and fixed to the movable housing 60 extends upward from the bottom plate portion 73A of the U-shaped portion 73. In a bottom face view looking at the movable terminal 70 from below, the base portions of the pair of side plate portions 73B of the U-shaped portion 73 are not hidden by the movable-side sliding portion 71. Accordingly, the first fixing portion 62 is able to be press fitted into the movable housing 60 in an appropriate manner by pushing the base portions of the pair of side plate portions 73B not hidden by the movable-side sliding portion 71 upward from the lower side of the movable terminal 70.

Further, in the present exemplary embodiment, the latching projections 73BA are formed at the leading end sides of the pair of side plate portions 73B. Accordingly, the pair of side plate portions 73B of the U-shaped portion 73 configure second fixed portions that are press fitted and fixed to the movable housing 60.

This enables wobble of the movable terminal 70 with respect to the movable housing 60 in a direction about an up-down direction axis of rotation to be suppressed.

Further, in the present exemplary embodiment, the guide portions 76 that have a greater width dimension than the contact portions 75 are formed further to the upper side than the contact portions 75, enabling the terminal portion 82 of the connection target 80 to be guided so as to achieve electrical continuity in an appropriate manner.

Further, in the connection structure in which the connector 10 of the present exemplary embodiment is connected to the connection target 80, the movable housing 60 is positioned at an upward limit position limited by the upper limiting portion (the upper wall portions 23 of the clips 20), and adopts a state in which upward load acts on the stationary housing 30 through the upper limiting portion. Downward load on the stationary housing 30 due to elastic force from the terminal is cancelled out by this load, thereby reducing load placed on the substrate by the stationary housing 30. This enables a connection structure in which the substrate 90 is not liable to warp.

MODIFIED EXAMPLES

Explanation follows regarding a first modified example to a third modified example.

Figure 13A:
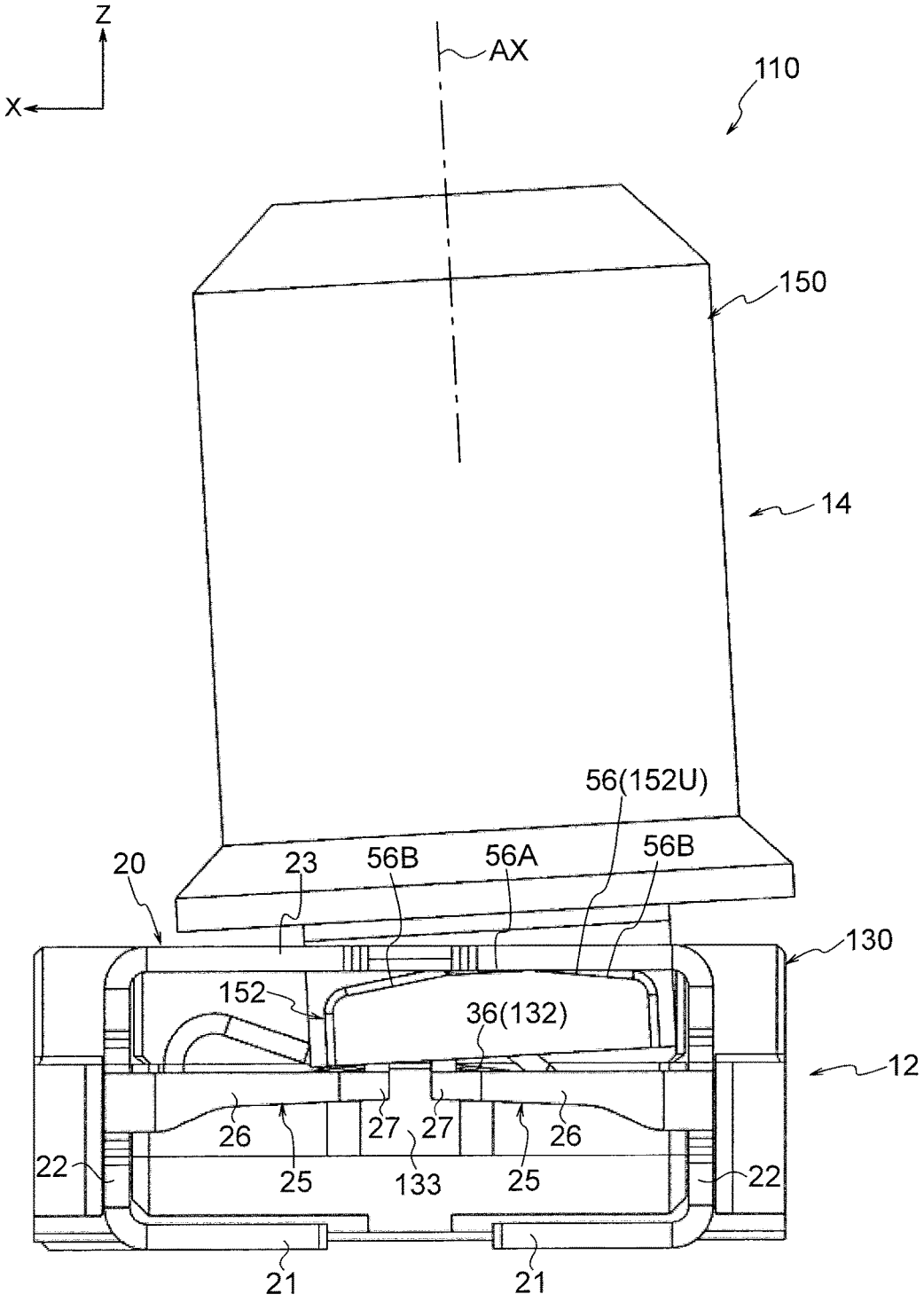
FIG. 13A is a side view of a connector of a first modified example.
Figure 13B:
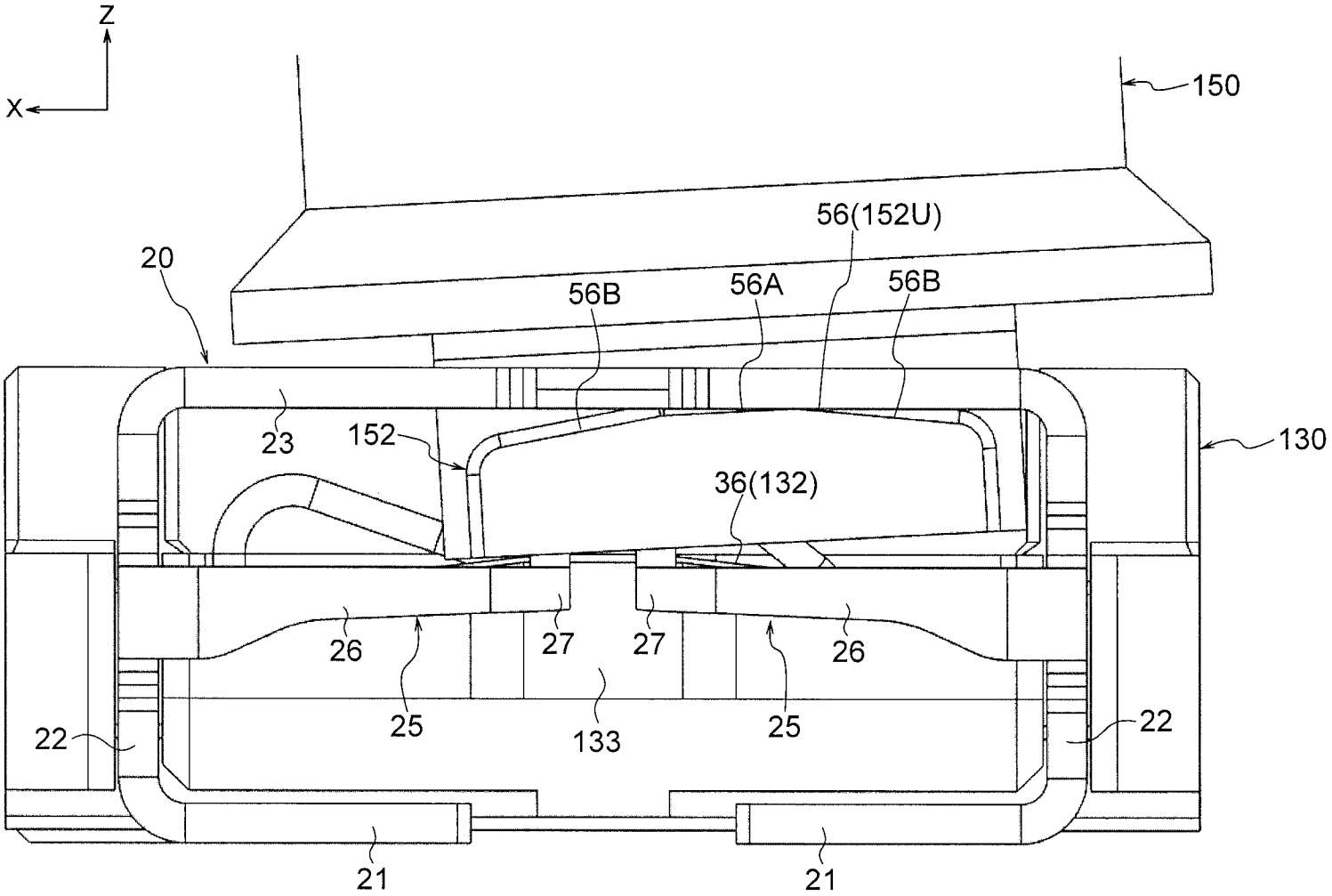
FIG. 13B is an enlarged view of part of FIG. 13A.
Figure 13C:
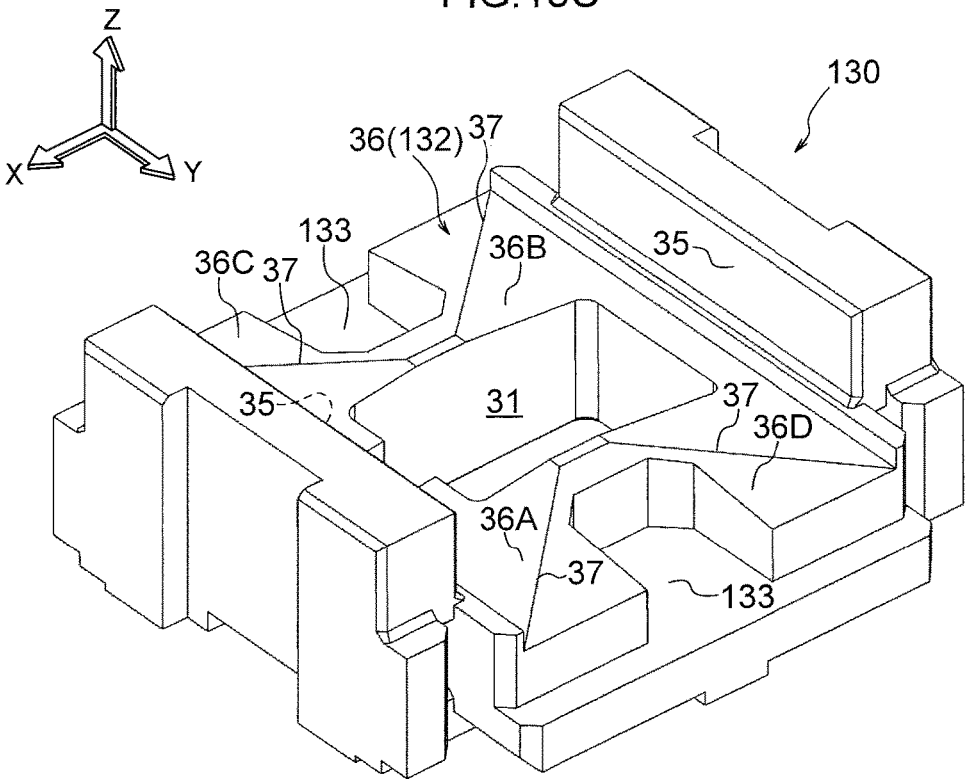
FIG. 13C is a perspective view of a stationary housing of the first modified example.

First Modified Example: Modified Examples of Limited Portion and Limiting Face Portion FIG. 13A and FIG. 13B illustrate a connector 110 of the first modified example. FIG. 13C illustrates a stationary housing 130 of the connector 110. In the connector 110, limited portions 152 of a movable shield 150 and a limiting face portion 132 of the stationary housing 130 differ from the exemplary embodiment described above. In the drawings, features that are similar to those of the exemplary embodiment described above are appended with the same reference signs, and explanation thereof will not be given.

As illustrated in FIG. 13A and FIG. 13B, an upper face 152U of each limited portion 152 of the movable shield 150 is formed with a sloped face 56 that protrudes upwards. Specifically, the upper face 152U of each limited portion 152 is configured including a horizontal face 56A at a front-rear direction intermediate portion thereof, and inclined faces 56B positioned at the front and rear of the horizontal face 56A. The inclined faces 56B are formed so as to be contiguous with the horizontal face 56A, and each slopes downward along a direction moving away from the horizontal face 56A (the front-rear direction).

As illustrated in FIG. 13C, the limiting face portion 132 of the stationary housing 130 of the first modified example is formed with a protruding sloped face 36. Specifically, the limiting face portion 132 of the stationary housing 130 is configured including a front inclined face 36A, a rear inclined face 36B, a right inclined face 36C, and a left inclined face 36D, each of which is a planar surface. The normal of the front inclined face 36A is a direction inclined slightly to the front with respect to the upwards direction, the normal of the rear inclined face 36B is a direction inclined slightly to the rear with respect to the upwards direction, the normal of the right inclined face 36C is a direction inclined slightly to the right with respect to the upwards direction, and the normal of the left inclined face 36D is a direction inclined slightly to the left with respect to the upwards direction. Ridge lines 37 are formed at the borders between the front inclined face 36A, the rear inclined face 36B, the right inclined face 36C, and the left inclined face 36D where these faces are adjacent to one another, the respective faces being contiguously connected to one another.

Further, one recess 133 is formed in the stationary housing 130 on each of the left and right sides of the stationary housing 130. Two stationary-side contact portions 27 of the clips 20 are disposed in each of the left and recesses 133.

In the first modified example, the upper wall portions 23 of the clips 20, serving as upper limiting portions, abut the sloped faces 56 of the limited portions 152 so as to limit the range of upward movement of the movable housing 60. In addition to the range of upward movement of the movable-side member 14 being limited by the horizontal faces 56A abutting the upper wall portions 23, as illustrated in FIG. 13A and FIG. 13B, the axis AX of the movable-side member 14 is also permitted to tilt by a large amount.

The first modified example thus permits the movable housing 60 to tilt by a large amount while suppressing an increase in the range of motion of the movable housing 60 in the up-down direction.

Further, in the first modified example, the sloped face 36 protruding upward at the limiting face portion 132 of the stationary housing 130 abuts the limited portion 152 of the movable shield 150 from the lower side so as to limit the range of downward movement of the movable-side member 14. This also permits the movable housing 60 to tilt by a large amount while suppressing an increase in the range of motion of the movable housing 60 in the up-down direction.

Second Modified Example: Modified Example of Clips

Figure 14:
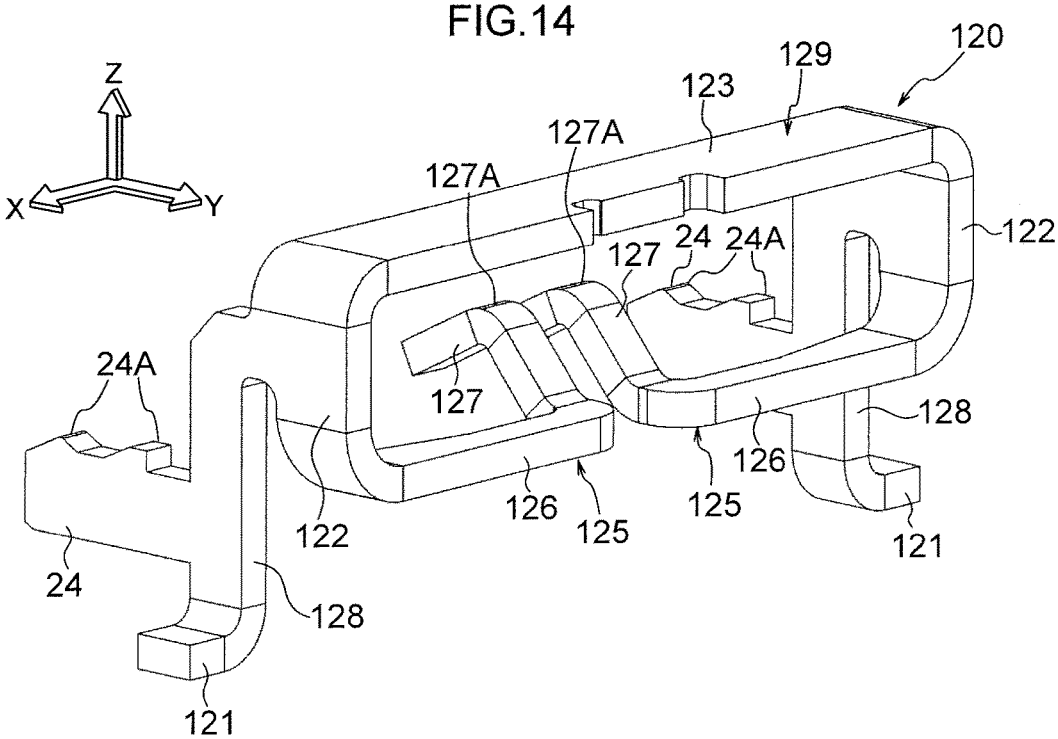
FIG. 14 is a perspective view of a clip of a second modified example.

FIG. 14 illustrates a clip 120 of the second modified example.

The clips 20 of the exemplary embodiment described above and the clips 120 of the second modified example are both formed by being bent after being punched from a metal sheet blank.

However, in contrast to the exemplary embodiment described above, the clips 120 of the second modified example are configured so as to make contact with the movable shield 50 at smooth faces of the clips 120 rather than at a punch-sheared face thereof. The specific shape of each clip 120 is explained below.

In each clip 120, a front upright portion 128 is formed extending upward from a rear end of a front substrate-fixed portion 121, and a rear upright portion 128 is formed extending upward from a front end of a rear substrate-fixed portion 121.

Each clip 120 includes a roll section 129. The roll section 129 includes front and rear vertical wall portions 122, an upper wall portion 123 that couples upper ends of the front and rear vertical wall portions 122 together, and elastic support portions 126 that project toward the connector front-rear direction center from lower ends of the front and rear vertical wall portions 122. The vertical wall portions 122, the upper wall portion 123, and the elastic support portions 126 are connected to one another through bent portions that have been bent in a plate thickness direction. The overall roll section 129 (the vertical wall portions 122, the upper wall portion 123, and the elastic support portions 126) is oriented such that a plate thickness direction thereof lies in a plane perpendicular to the connector width direction.

The roll section 129 is connected to the front and rear upright portions 128 at the connector width direction center of the vertical wall portions 122.

Stationary-side contact portions 127 extend toward the connector width direction center from leading end sides of the elastic support portions 126. The stationary-side contact portions 127 are bent in their plate thickness direction so as to be curved convexly upward. Apexes 127A are configured at the convexly curved portions. The apexes 127A slidingly contact part of the movable-side member 14 (the limited portions 52 of the movable shield 50). Namely, smooth faces of the clip 120 slide against part of the movable-side member 14. Accordingly, wear due to the movable shield 50 and the clip 120 sliding against one another is less liable to arise, and stable electrical continuity is achieved between the movable shield 50 and the clip 120.

Third Modified Example: Modified Example of Movable Terminal

Figure 15A:
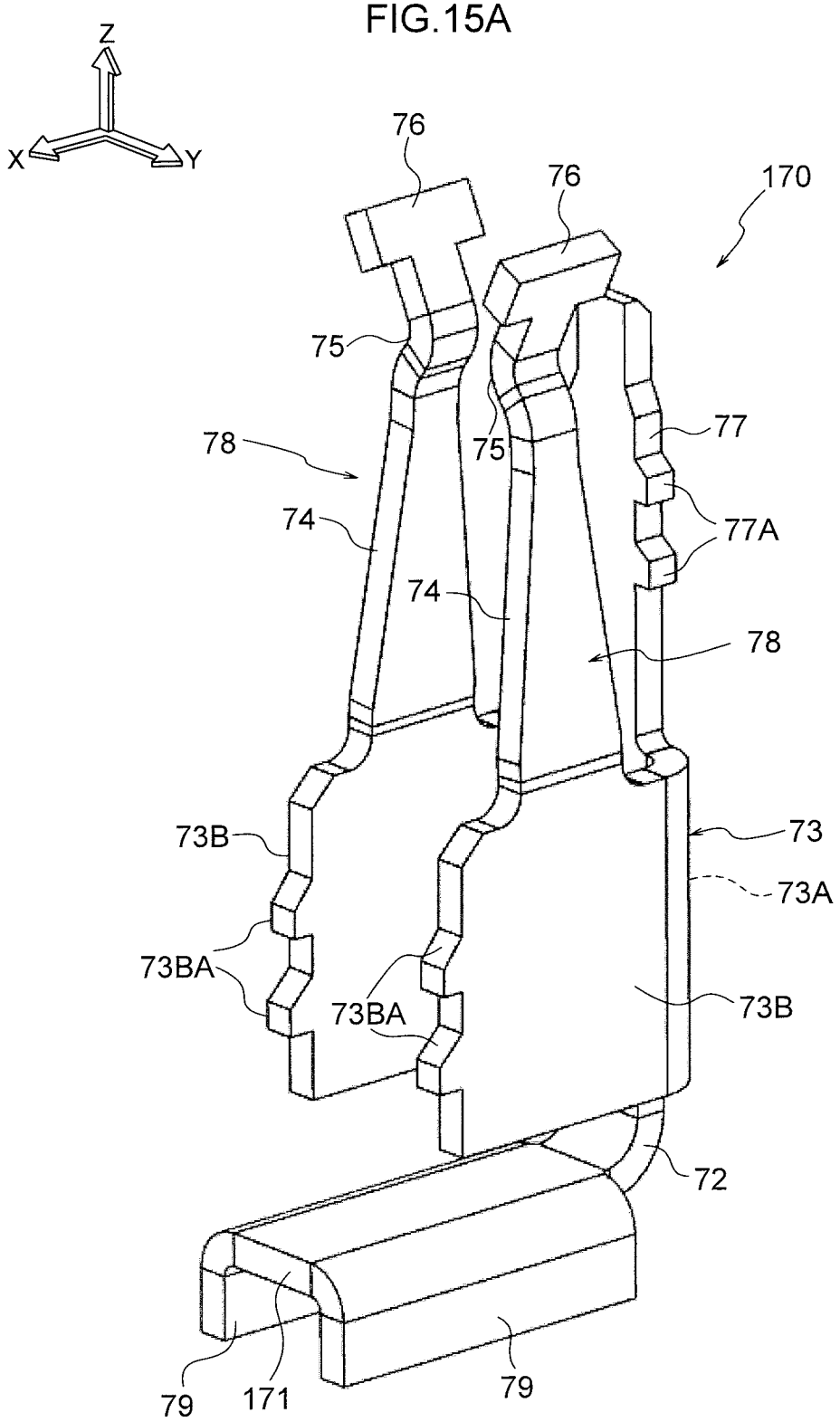
FIG. 15A is a perspective view of a movable terminal of a third modified example.

FIG. 15A illustrates a movable terminal 170 of the third modified example. The movable terminal 170 of the third modified example differs from the movable terminal 70 in the exemplary embodiment described above in that it further includes left and right abutting portions 79. In the drawings, features that are similar to those of the exemplary embodiment described above are appended with the same reference signs, and explanation thereof will not be given.

The left and right abutting portions 79 are formed bending downward from both width direction sides of a movable-side sliding portion 171. Upper ends of the abutting portions 79 are connected to width direction end portions of the movable-side sliding portion 171 through bent portions. The left and right abutting portions 79 have their plate thickness directions in the connector width direction. Note that the width dimension of the movable-side sliding portion 171 is formed so as to be smaller than that of the movable-side sliding portion 71 of the exemplary embodiment described above.

Figure 15B:
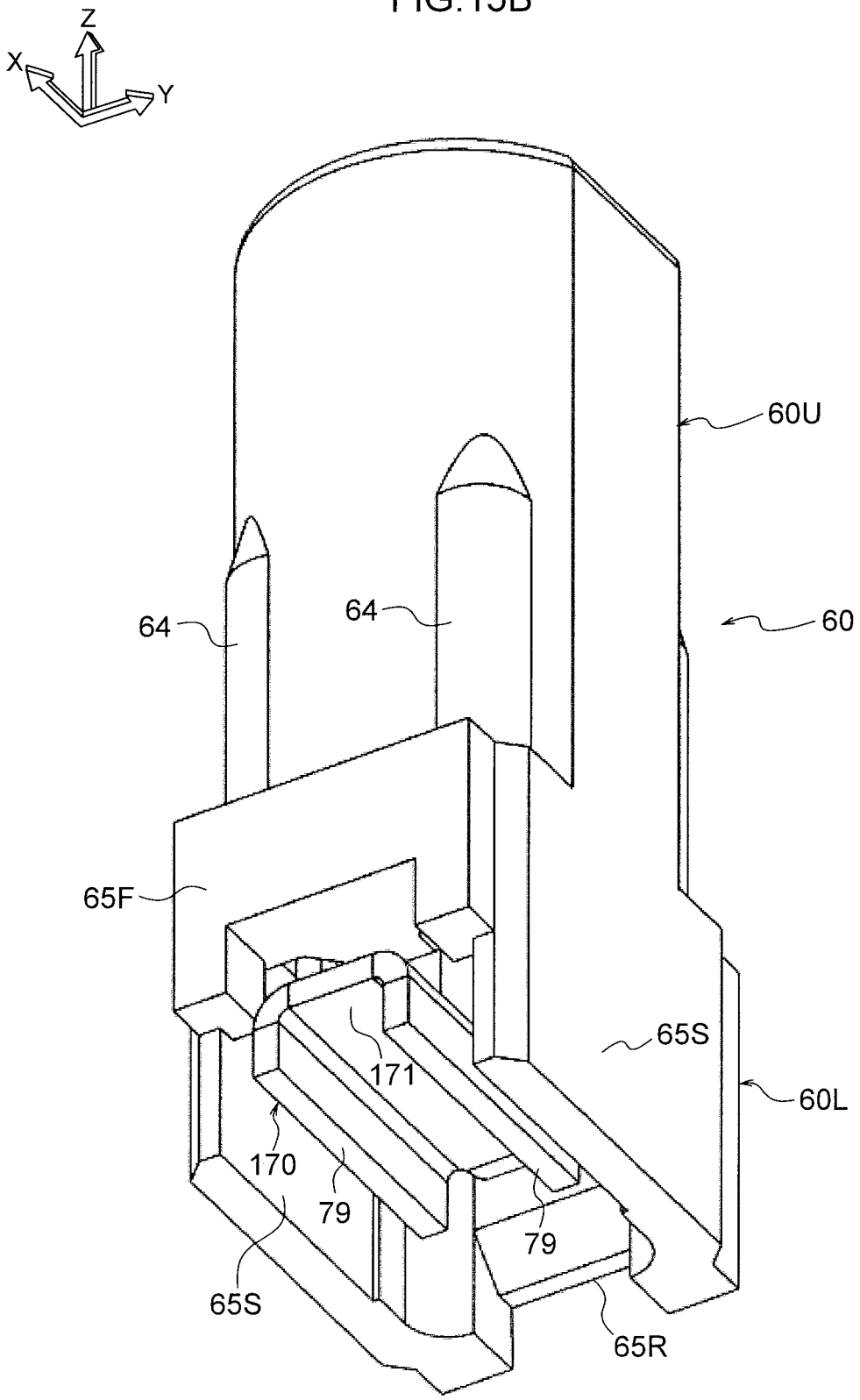
FIG. 15B is a perspective view of a movable terminal of the third modified example in a state retained in a stationary housing as seen obliquely from below.
Figure 15C:
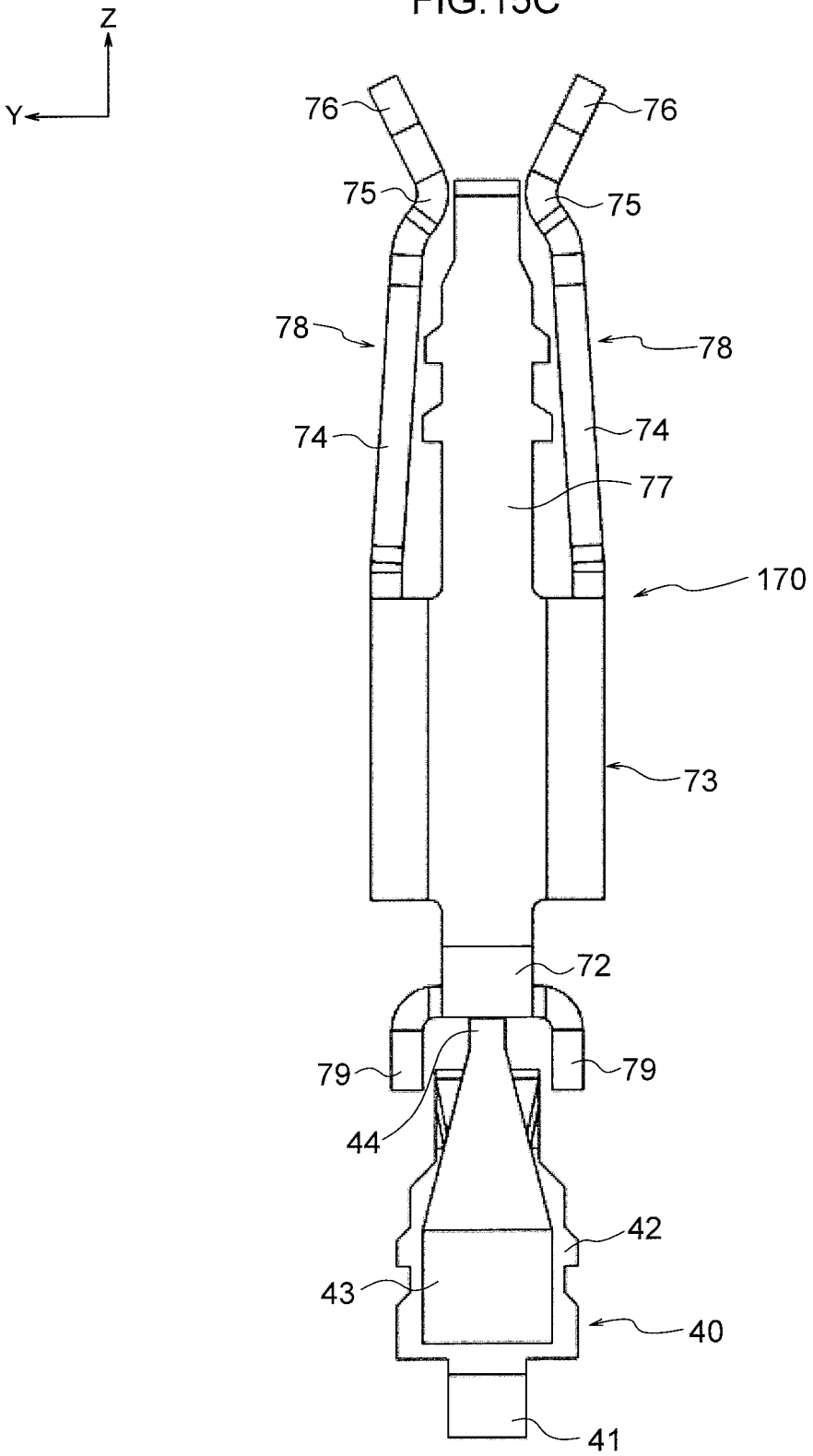
FIG. 15C illustrates a movable terminal of the third modified example in a state contacting a stationary terminal as seen from behind.

As illustrated in FIG. 15C, the distance across which the left and right abutting portions 79 face one another (namely, the width dimension of the movable-side sliding portion 171) is larger than the width dimension of the stationary-side sliding portion 44 of the stationary terminal 40, specifically at least three times as large. The stationary-side sliding portion 44 of the stationary terminal 40 accordingly slides in the left-right direction over a smooth face at the lower side of the movable-side sliding portion 171 within the limits permitted by the width dimension of the movable-side sliding portion 171.

For example, if the movable housing 60 moves to the left, the movable terminal 170 also moves to the left so as to follow the movable housing 60. When this happens, the stationary-side sliding portion 44 and the movable-side sliding portion 171 slide in the left-right direction, after which the right abutting portion 79 abuts the stationary-side sliding portion 44 from the right and the stationary terminal 40 elastically deforms. Specifically, the stationary terminal 40 elastically deforms such that the spring section 43 of the stationary terminal 40 is inclined with respect to the front-rear direction in plan view.

Similarly, if the movable housing 60 moves to the right, the corresponding abutting portion 79 of the movable terminal 170 abuts the stationary-side sliding portion 44 of the stationary terminal 40 such that the stationary terminal 40 elastically deforms.

Thus, in third modified example, the stationary terminal 40 is elastically deformed by the abutting portions 79 even when there has been a large amount of positional offset in the connector left-right direction, enabling electrical continuity between the stationary terminal 40 and the movable terminal 170 to be maintained and enabling this positional offset to be absorbed while suppressing dimensional enlargement of the movable-side sliding portion 171 in the left-right direction.

Further, reducing the width dimension of the movable-side sliding portion 171 enables the side walls 65S of the lower section 60L of the movable housing 60 to be formed thicker toward the inside of the housing than the thickness of the movable housing 60 illustrated in FIG. 15B. In cases in which the side walls 65S are formed thicker, it is preferable that configuration be made such that the side walls 65S make contact with both of the left and right abutting portions 79 of the movable terminal 170.

SUPPLEMENTARY DESCRIPTION

Note that although the exemplary embodiment was explained using an example in which the stationary terminal 40 and the movable terminal 70 are formed as separate bodies, and contacting the stationary terminal 40 to the movable terminal 70 electrically connects the substrate connection portion 41 of the stationary terminal 40 and the contact portions 75 of the movable terminal 70, the present invention is not limited thereto. For example, the stationary terminal 40 and the movable terminal 70 maybe formed together as a single terminal (a single terminal including a stationary terminal and a movable terminal) from the outset, such that the substrate connection portion 41 of the stationary terminal 40 and the contact portions 75 of the movable terminal 70 are electrically connected. In such cases, a spring section that readily deforms is preferably provided between the substrate connection portion 41 and the contact portions 75.

Further, the exemplary embodiment was explained using an example in which within the range of movement of the movable housing 60 (movable-side member 14), the (elastic spring sections 25 of the) clips 20 are held in an elastically deformed state at all times, and elastic force due to this elastic deformation secures the contact pressure between the clips 20 and the movable shield 50, while the movable shield 50 is die cast and does not elastically deform. However, configuration may be made such that part of the movable shield 50 is formed so as to be capable of elastic deformation, and within the range of movement of the movable housing 60 (movable-side member 14), this part of the movable shield 50 is in an elastically deformed state at all times so as to secure contact pressure between the movable shield 50 and the clip 20.

Further, the exemplary embodiment was explained using an example in which within the range of movement of the movable housing 60 (movable-side member 14), the stationary terminal 40 is held in an elastically deformed state at all times, and the elastic force due to this elastic deformation secures contact pressure between the stationary terminal 40 and the movable terminal 70. However, configuration may be made such that within the range of movement of the movable housing 60 (movable-side member 14), a movable terminal is held in an elastically deformed state at all times, and the elastic force due to this elastic deformation secures contact pressure between a stationary terminal and the movable terminal.

Further, although the exemplary embodiment was explained using an example in which elastic force from part (the elastic spring sections 25) of the clips 20 elastically contacts part (the limited portions 52) of the movable-side member 14 from the lower side, configuration may be made such that elastic force from part of a stationary shield elastically contacts part of a movable-side member from the upper side. For example, elastic spring sections may be formed to parts of the upper wall portions 23 of the clips 20, and these made to elastically contact limited portions from the upper side, and portions of the elastic spring sections 25 of the exemplary embodiment may be configured as lower limiting portions formed such that they do not readily elastically deform (as portions that abut the movable-side member from the lower side so as to limit the range of downward movement of the movable-side member).

In such cases, the limited portions of the movable shield are sandwiched between the lower limiting portions and other parts of the stationary shield in the up-down direction so as to make elastic contact therewith and provide stable electrical continuity between the clips 20 and the movable shield 50.

Further, although the exemplary embodiment was explained using an example in which the movable housing 60 (movable-side member 14) was able to move within a given range of motion in the connector up-down direction, configuration may be such that the movable housing 60 (movable-side member 14) is unable to move in the connector up-down direction.

What is claimed is:

1. A connector comprising:

a stationary housing configured to be fixed to a substrate;

a movable housing that is capable of moving in a front-rear direction and a left-right direction with respect to the stationary housing, the front-rear direction and the left-right direction being mutually orthogonal and running parallel to a planar surface of the substrate;

a stationary terminal that includes a substrate connection portion configured to be connected to the substrate, and that is retained at the stationary housing;

a movable terminal that includes a contact portion that makes contact with a terminal portion of a connection target provided with the terminal portion and a shield connection portion, and that is retained at the movable housing, the contact portion of the movable terminal being configured to follow movement of the movable housing;

a movable shield that makes contact with the shield connection portion of the connection target, that is fixed to the movable housing so as to shield the movable terminal, and that follows movement of the movable housing; and a stationary shield that is formed separately from the movable shield, and that is configured to be fixed to the substrate;

the substrate connection portion and the contact portion being electrically connected to one another;

the movable shield and the stationary shield being in mutual contact so as to have electrical continuity; and the stationary shield and the movable shield being configured to slide against one another while maintaining electrical continuity when the movable housing moves in the front-rear direction or the left-right direction with respect to the stationary housing, wherein:

the movable shield includes a limited portion;

the stationary shield includes an elastic spring section, and a limiting portion that abuts the limited portion so as to limit a range of movement of the movable housing toward one up-down direction side;

the stationary shield is a member formed of one metal sheet blank, and the elastic spring section and the limiting portion are formed in the same member;

the limited portions of the movable shield are sandwiched between the limiting portion and the elastic spring section of the stationary shield in the up-down direction; and within a range of movement of the movable housing, the elastic spring section is in an elastically deformed state at all times, and elastic force due to this elastic deformation acts along a direction placing the stationary shield and the movable shield in pressing contact so as to have electrical continuity.

2. The connector of claim 1, wherein:

the movable shield includes a tube-shaped tubular portion; and the tubular portion surrounds the movable terminal in the front-rear and left-right directions.

3. The connector of claim 2, wherein there are no circumferential joints in the tubular portion of the movable shield.

4. The connector of claim 1, wherein:

within a range of movement of the movable housing, at least one of the stationary shield or the movable shield is in an elastically deformed state at all times, an elastic force due to this elastic deformation acts along a direction placing the stationary shield and the movable shield in pressing contact so as to have electrical continuity.

5. The connector of claim 1, wherein:

the movable shield includes a limited portion;

the stationary housing includes a limiting face portion that abuts the limited portion from a lower side so as to limit a range of downward movement of the movable housing; and the limiting face portion includes a sloped face protruding upward.

6. The connector of claim 1, wherein:

the stationary shield is configured by a member made by bending a punched sheet blank; and a smooth face of the stationary shield, rather than a punch-sheared face of the stationary shield, makes contact with the movable shield so that the stationary shield and the movable shield have electrical continuity.

7. The connector of claim 1, wherein:

the limiting portion is an upper limiting portion that abuts the limited portion from an upper side so as to limit a range of upward movement of the movable housing;

the limited portion includes a lower face that makes contact with the elastic spring section of the stationary shield;

the elastic spring section press the limited portion upward due to elastic force from the elastic spring section.

8. A connector, comprising:

a stationary housing configured to be fixed to a substrate;

a movable housing that is capable of moving in a front-rear direction and a left-right direction with respect to the stationary housing, the front-rear direction and the left-right direction being mutually orthogonal and running parallel to a planar surface of the substrate;

a stationary terminal that includes a substrate connection portion configured to be connected to the substrate, and that is retained at the stationary housing;

a movable terminal that includes a contact portion that makes contact with a terminal portion of a connection target provided with the terminal portion and a shield connection portion, and that is retained at the movable housing, the contact portion of the movable terminal being configured to follow movement of the movable housing;

a movable shield that makes contact with the shield connection portion of the connection target, that is fixed to the movable housing so as to shield the movable terminal, and that follows movement of the movable housing; and a stationary shield that is formed separately from the movable shield, and that is configured to be fixed to the substrate, the substrate connection portion and the contact portion being electrically connected to one another, the movable shield and the stationary shield being in mutual contact so as to have electrical continuity, and the stationary shield and the movable shield being configured to slide against one another while maintaining electrical continuity when the movable housing moves in the front-rear direction or the left-right direction with respect to the stationary housing, wherein:

the movable shield includes a limited portion;

the stationary shield includes an elastic spring section, and a limiting portion that abuts the limited portion so as to limit a range of movement of the movable housing toward one up-down direction side;

the elastic spring section includes a stationary-side contact portion that makes contact with the other up-down direction side of the limited portion, and an elastic support portion that elastically supports the stationary-side contact portion and extends in a direction along the planar surface of the substrate; and the elastic support portion causes the stationary-side contact portion to make pressing contact with the limited portion even in a state in which the limited portion has abutted the limiting portion.

9. The connector of claim 8, wherein:

the limiting portion is an upper limiting portion that abuts the limited portion from an upper side so as to limit a range of upward movement of the movable housing;

the stationary housing includes a limiting face portion that abuts the limited portion from a lower side so as to limit a range of downward movement of the movable housing, and a recess that is formed in the limiting face portion; and the stationary-side contact portion is pressed by the limited portion and fits into the recess when the limited portion approaches the limiting face portion.

10. The connector of claim 8, wherein:

the limiting portion is an upper limiting portion that abuts the limited portion from an upper side so as to limit a range of upward movement of the movable housing; and the limited portion includes a sloped face protruding upward at a portion that abuts the upper limiting portion.

* * * * *